US006517178B1

(12) United States Patent
Yamamoto et al.

(10) Patent No.: US 6,517,178 B1
(45) Date of Patent: Feb. 11, 2003

(54) IMAGE FORMING METHOD AND APPARATUS

(75) Inventors: Ryoichi Yamamoto, Kanagawa (JP); Nobuo Matsumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/472,970

(22) Filed: Dec. 28, 1999

(30) Foreign Application Priority Data

Dec. 28, 1998 (JP) ..... 10-374664

(51) Int. Cl.[7] ..... B41J 2/205
(52) U.S. Cl. ..... 347/15; 347/43
(58) Field of Search ..... 346/140.1; 347/15, 347/98, 103, 21, 43

(56) References Cited

U.S. PATENT DOCUMENTS

| | | | | |
|---|---|---|---|---|
| 4,069,485 A | | 1/1978 | Martin | 347/12 |
| 4,109,282 A | | 8/1978 | Robertson et al. | 347/98 X |
| 4,614,953 A | | 9/1986 | Lapeyre | |
| 4,734,717 A | * | 3/1988 | Rayfield | 347/87 X |
| 5,099,256 A | * | 3/1992 | Anderson | 347/103 |
| 5,371,529 A | | 12/1994 | Eguchi et al. | |
| 5,646,656 A | | 7/1997 | Leonhardt | 347/43 |
| 5,777,636 A | * | 7/1998 | Naganuma et al. | 347/15 X |
| 5,790,152 A | * | 8/1998 | Harrington | 347/15 X |

FOREIGN PATENT DOCUMENTS

| | | | | |
|---|---|---|---|---|
| EP | 0023433 | | 2/1981 | |
| EP | 0739742 | | 10/1996 | |
| JP | 63-291663 A | * | 11/1988 | B05C/5/00 |
| JP | 3-207664 | | 9/1991 | |
| JP | 5-201024 | | 8/1993 | |
| JP | 7-125259 | | 5/1995 | |
| JP | 9-156131 | | 6/1997 | |
| JP | 10-264372 | | 10/1998 | |

* cited by examiner

*Primary Examiner*—Lamson Nguyen
(74) *Attorney, Agent, or Firm*—Birch, Stewart, Kolasch & Birch, LLP

(57) ABSTRACT

An image forming method and apparatus for ejecting a ink liquid fluid constituted by plural inks from a common ink ejection port while changing a mixture proportion of the plural inks with respect to one pixel based on an image signal. The ejected fluid is transported to an image receiving medium which is moved relatively to the ink ejection port to form an image. A flow rate of at least one image forming ink of the plural inks is controlled so as not to be always zero. The image quality is prevented from being deteriorated by undesired mixing of inks due to natural diffusion of the image forming ink into other inks. A minimum addition amount of the image forming ink can be equal to or above a flow rate required for refreshing a volume of the image forming ink mixed with any other ink by natural diffusion.

49 Claims, 14 Drawing Sheets

IMAGE FORMING METHOD AND APPARATUS

BACKGROUND OF THE INVENTION

1. Field of the Invention

The present invention relates to an image forming method and apparatus for generating a fluid having a predetermined density and/or a predetermined color by changing a mixture proportion of a plurality of inks based on an image signal and leading the thus obtained fluid to an image receiving medium to form an image. Further, the present invention relates to a recording head for use in this image forming apparatus.

2. Description of the Prior Art

U.S. Pat. No. 4,109,282 (which will be referred to as a prior art reference 1, hereinafter) discloses a printer having a structure such that a valve called a flap valve is provided in a flow channel for leading two types of liquid, i.e., clear ink and black ink onto a substrate for forming an image. The flow channel for each ink is opened/closed by displacing this valve so that the two types of liquid are mixed in a desired density to be transferred onto the substrate. This enables printout of an image having the gray scale information which is the same as that of the image information displayed on a TV screen. In this reference is disclosed that a voltage is applied between the flap valve and an electrode provided on a surface opposed to the flap valve and the valve itself is mechanically deformed by the electrostatic attracting force to cause displacement of the valve. Further, the ink is absorbed in paper by a capillary phenomenon between fibers of the print paper.

U.S. Pat. No. 4,614,953 (which will be referred to as a prior art reference 2, hereinafter) discloses a printer head apparatus by which only a desired amount of multiple types of ink having different colors and solvent is led to a third chamber to be mixed therein. In this reference is disclosed that a chamber and a diaphragm-type piezoelectric effect device attached to this chamber are used as means for check-weighing a desired amount of ink and a pressure pulse obtained by driving this piezoelectric device is utilized.

Unexamined Japanese Patent Publication (KOKAI) No. 201024/1993 (which will be referred to as a prior art reference 3, hereinafter) discloses an ink jet print head including: a liquid chamber in which a carrier liquid is filled; ink jet driving means provided in the liquid chamber; a nozzle communicating with the liquid chamber; and a mixing portion for mixing ink to the carrier liquid in this nozzle. In this reference is also disclosed that adjusting means for adjusting an amount of mixture of ink to a desired value is provided.

Similarly, Unexamined Japanese Patent Publication (KOKAI) No. 125259/1995 (which will be referred to as a prior art reference 4, hereinafter) discloses an ink jet recording head including: first and second supplying means for supplying inks having first and second densities, respectively; and controlling means which controls an amount of supply of the second ink by the second supplying means so that a desired ink density can be obtained.

In this reference 4, employment of a micro-pump which has an exclusive heating device and is driven by its heat energy is disclosed. As this micro-pump, there is disclosed an example such that the heat energy is generated by the heating device and a pressure obtained by the nucleate boiling caused due to the heat energy is used to drive, e.g., a piston-type valve or a cantilever-like valve. Further, this reference 4 describes that an inflow of ink can be effectively controlled in an area where an inflow is particularly small by adopting an actuator consisting of shape memory alloy to this valve.

Unexamined Japanese Patent Publication (KOKAI) No. 207664/1991 (which will be referred to as a prior art reference 5, hereinafter) discloses a structure which is similar to that in the prior art reference 2 but does not use a third chamber for mixing a plurality of types of ink.

Unexamined Japanese Patent Publication (KOKAI) No. 156131/1997 (which will be referred to as a prior art reference 6, hereinafter) discloses an ink jet printer comprising a plurality of printer heads for forming an image having multiple colors based on image data. Ink and diluent are mixed to obtain diluted ink which is jetted from a nozzle so that a recording image is formed on a recording medium. The ink jet printer ejects the diluent from at least one printer head out of the multiple printer heads when all-white image data, that is, data representing that amount of mixture of ink is too small to realize a clear printing density, is input. As a result, a rapid change in tone (a tone jump) is prevented and the additional consumption of the diluent is suppressed to improve drying characteristics.

Unexamined Japanese Patent Publication (KOKAI) No. 264372/1998 (which will be referred to as a prior art reference 7, hereinafter) discloses employment of a plurality of line heads in which ink ejection nozzles are linearly aligned. In this example, when the respective line heads are biased and arranged in a direction for feeding print paper and positions of nozzles in the respective line heads are biased relatively to a direction of the width of the print paper, the pixel density can be enhanced. Further, ink having a single color is ejected from each nozzle, and ink droplets having different colors are combined by ejecting ink having different colors in accordance with the line heads, thereby representing predetermined colors on the print paper.

In the prior art disclosed in the prior art reference 1, the ejection ports for two types of liquid are separately formed directly on the print paper, and the respective types of liquid are separately attracted on the print paper by the capillary phenomenon immediately after ejection. Therefore, a quantity of attraction of each liquid on the paper readily fluctuates under the influence of the paper quality of the print paper, which results in the unstable image quality or difficulty of formation of an image having high fidelity to the image signal.

In any of the prior arts disclosed in the prior art references 2 to 6, a plurality of inks are previously mixed or caused to be confluent, and thereafter the mixed liquid (including the confluent liquid) is led onto the print paper. A plurality of the inks are brought into contact with each other in the mixing portion (the confluence portion), and each ink is ejected by a predetermined amount to be mixed. Namely, the ejection port for each ink is formed and assembled in the mixing portion. Each ink can not therefore prevent from being naturally diffused with each other.

For example, even if a given ink is not ejected into a mixing chamber in accordance with the image signal, this ink is naturally diffused in the mixing chamber. Thus, the density and/or color of the finally mixed ink liquid differs from the image signal, and an image which is true to the image signal can not be formed. When the distortion of the contact interface occurs due to a vibration in the mixing portion or any other disturbance even though the natural diffusion of the ink is small, the undesired mixing of ink is facilitated and the above-described problem becomes more prominent.

Since the ink having a single color is ejected from one nozzle in the prior art disclosed in the prior art reference 7, one pixel is formed by multiple (three, four or more colors) ink droplets. Therefore, the pixel density is hard to be enhanced, and improvement of the image quality is also restricted.

In the prior art reference 3 is disclosed that adjusting means functioning as a check valve is provided in the vicinity of the opening of the ink channel formed in the mixing portion in order to mainly prevent the inks from being naturally diffused with each other. However, provision of the adjusting means having the check valve structure complicates the print head configuration and leads to problems such as difficulty in manufacturing, reduction in productivity or increase in the manufacturing cost.

Further, although in the prior art reference 6 is disclosed that the colorless diluent continues to flow in case of all-white image data in order to avoid a rapid change in tone (tone jump), the ink which is not colorless and transparent is continuously diffused in this diluent in this case, and hence the above-mentioned problems can not be prevented.

SUMMARY OF THE INVENTION

The present invention has been accomplished under the circumstances as aforementioned, and a first object thereof is to provide an image forming method, wherein, when an ink liquid having a desired density and/or color is generated by mixing inks having multiple different densities and/or colors and this ink liquid is transported to an image receiving medium to form an image, such a problem as that an image having high fidelity to an image signal can not be obtained because the density and/or color of the ink liquid differs from the image signal by mixing at least an image forming ink into the ink liquid whose mixture proportion is set by the image signal by natural diffusion and the like is solved by an extremely simple method, thereby obtaining an image which is true to the image signal.

In addition, it is a second object of the present invention to provide an image forming apparatus used for implementing this method. Moreover, it is a third object of the present invention to provide an recording head used for manufacturing the image forming apparatus.

According to the present invention, the first object can be attained by an image forming method for ejecting a fluid constituted by a plurality of inks from a common ink ejection port while changing a mixture proportion of a plurality of said inks with respect to one pixel based on an image signal and transporting a plurality of said inks to an image receiving medium which is moved relatively to said ink ejection port to form an image; wherein at least one of a plurality of said inks is an image forming ink for substantially forming an image after dried out and an ink flow rate of said image forming ink is controlled in such a manner that a volume flow rate per unit time does not become zero.

A minimum addition amount of the image forming liquid can be equal to or above a flow rate required for refreshing a volume of this image forming ink mixed with any other ink by natural diffusion. However, since the addition amount should be suppressed to such a value as that a change in density and/or color due to addition of this ink does not result in degradation of the image quality, it is preferable to set the addition value in such a manner that a change in optical density of the ink liquid due to addition of this ink is less than 0.1. Here, the optical density means such a degree as that a substance absorbs the light and, when it is assumed that the optical density is represented as D; an intensity of an incident light ray, $I_0$; and an intensity of a transmitted light ray; I, the optical density can be defined by $D=\log_{10}(I_0/I)$. It is preferable that vibration absorption is performed at a portion where a plurality of inks becomes confluent can suppress generation of turbulence of the contact interface due to vibration and disturbance of the ink to prevent diffusion.

Print paper may be used as the image receiving medium, and an image can be directly formed on this print paper. However, it is possible to adopt a mode such that a drum-like or belt-like intermediate image receiving medium is provided between the ejection port and the image receiving medium such as a recording sheet and the ink liquid supplied from the ejection port is loaded on the intermediate image receiving medium, so that the ink liquid is then transferred to the image receiving medium. Preferably, the ink ejection ports may be separately provided in accordance with pixels aligned in a direction of the width of the image receiving medium (a direction orthogonal to the moving direction). The ink ejection ports may be formed into a slot-shaped opening which is elongated in a direction of the width of the image receiving medium when changing the density and/or the color only in the moving direction of the image receiving medium.

When it is determined that at least one type of ink is image non-forming ink, i.e., ink which is or becomes transparent and colorless after dried out (which will be referred to as image non-forming ink or clear ink hereinafter), the density can be controlled by changing a proportion or mixing ratio of the image non-forming ink in the ink liquid. It is preferable to add the image non-forming ink to the ink liquid any time so that the amount of supply of the image non-forming ink not become zero. In such a case, when a decoloration preventing agent such as antioxidant, ultraviolet ray absorber or any other component is included in the image non-forming ink in advance, a color degradation preventing property and others can be imparted to an image. A plurality of inks are determined as inks having colors of yellow, magenta and cyan, and changing a mixture proportion of these inks can form a color image.

Controlling flow rates of a plurality of inks can form an image whose density and/or color can vary in both the moving direction and the width direction of the image receiving medium.

A plurality of inks ejected from the ink ejection port may be transported, i.e., jetted on the image receiving medium as droplets by the ink jet mode, but it is also possible transport a plurality of the inks to the image receiving medium as a continuous flow in place of the droplets (the continuous coating mode). In case of this continuous coating mode, a flow of liquid can be ejected or extruded as a continuous flow and transported to the image receiving medium through a slot opening connecting the ink ejection ports provided for the respective pixels in the width direction.

A flow rate of a plurality of inks can be controlled by the various methods. For example, an ink supply pressure with respect to each ink channel can be maintained constant while a cross sectional area of each ink flow channel can be changed by a piezoelectric device. In this case, a diaphragm valve facing to the flow channel is opened/closed by the piezoelectric device. The piezoelectric device can be driven by a mechanical natural frequency (a resonance frequency) of the device itself, and the time period for driving the device is changed by varying a pulse number of this frequency in order to control the flow rate. It is also possible to continuously control a quantity of distortion (an opening of the diaphragm valve) of the piezoelectric device by an analog signal and, in this case, the flow rate is controlled by a voltage of the analog signal.

A flow rate supplied to each ink channel may be controlled by changing a discharged quantity of an ink feed pump. For example, the ink feed pump is driven by a pulse motor (a stepping motor), and the ink flow rate can be controlled by the driving pulse number of this pulse motor. The ink feed pump includes: at least one check valve provided to the ink channel; a cavity provided in the vicinity of this check valve; and a movable member for changing a volumetric capacity of the cavity, so that the pump discharges the ink by changing a volumetric capacity of the cavity. Such pump can be used as an ink feed pump.

The check valve used in the ink feed pump may be constituted by a geometrical form by which a resistance relative to the ink flow direction becomes small and that relative to the reverse direction becomes large. Such a check valve has no movable portion and can be produced by utilizing a method for manufacturing an integrated circuit or a printed wiring board or that for manufacturing a micromachine. The ink feed pump may be driven by the pulse motor.

When the ink feed pump driven by the pulse motor is provided, the ink feed pump used in this example may preferably be of a volumetric capacity type by which an amount of ejection is proportionate to a quantity of rotation of the motor and, for example, a pump for squeezing a flexible tube appressed against the inner surface of a circular case from the inner peripheral side by an eccentric in a defined direction, a vane pump, a gear pump and others are suitable.

The ink feed pump provided to each ink channel can be formed by the piezoelectric device and the check valve. In this case, the piezoelectric device is a diaphragm valve driven by a mechanical resonance frequency inherent to the device. By controlling the pulse number (pulse number in a defined period of time or a unit time) of the driving frequency of each piezoelectric device, a ejection volume flow rate from each ink channel can be controlled.

According to the present invention, the second object can be attained by an image forming apparatus for ejecting a fluid constituted by a plurality of inks from an ink ejection port while changing a mixture proportion of a plurality of said inks based on an image signal and transporting a plurality of said inks to an image receiving medium which is moved relatively to said ink ejection port to form an image, said image forming apparatus comprising:

ink flow controlling means for independently controlling ink flow rates of a plurality of said inks;

a processor for calculating an ink flow rate of each ink in such a manner a volume flow rate per unit time of at least one image forming ink for substantially forming an image after dried out does not become zero, while maintaining a mixture proportion of each ink corresponding to said image signal; and a driver for driving said ink flow controlling means based on a result of calculation by said processor.

In order to control the ink flow rate, a diaphragm-type flow control valve driven by a piezoelectric device may be provided to the respective ink channels, for example. In place of the diaphragm valve driven by the piezoelectric device, a diaphragm valve driven by the heat-pressure effect or a counterpart driven the electrostatic attraction force or the electrostatic repulsive force may be used. In such a case, it is needless to say that the ink supply pressure with respect to the ink channel is always maintained constant. Additionally, a discharge quantity of the ink feed pump for supplying ink to the ink channel can be controlled without using the flow control valve. Preferably, such pump is of a volumetric capacity type which is driven by the pulse motor.

The ink flow controlling means may comprises: a check valve provided to the ink channel; a cavity provided in the vicinity of the check valve; and a movable member for changing a capacity of the cavity and have a structure for ejecting the ink by varying a capacity of the cavity. In this example, the check valve may have a geometrical form such that an ink flow resistance with respect to a flow direction of the ink becomes small while the same with respect to the reverse direction becomes large. The movable member can be constituted by a diaphragm driven by the piezoelectric device (or formed by the piezoelectric device itself). The movable member can be made up of a diaphragm driven using the heat-pressure effect, the electrostatic attraction force or the electrostatic repulsive force, the magnetic distortion effect, the interfacial tension effect of a fluid which is different from the ink, and others or a diaphragm driven by air bubbles generated by the electrolytic process of a fluid which is different from the ink.

The ink ejection ports are arranged in accordance with pixels aligned in a direction of the width of the image receiving medium and they are independently opposed to the image receiving medium. In this case, the ink droplets can be transported by the ink jet mode. Additionally, in this case, the ink may be applied by the continuous coating mode in place of the ink jet mode. When using the continuous coating mode, the fluid ejected or extruded from each ink ejection port can be led to the image receiving medium through a slot opening which is elongated in a direction of the width of the image receiving medium. A flow of the ink liquid can be further stabilized as a steady flow to be led to the image receiving medium by using the slot opening in this manner.

In case of the continuous coating mode, the liquid ejected from the ink ejection port may be transported to an intermediate image receiving medium such as a transfer drum, and the ink liquid can be transferred from this intermediate image receiving medium onto a final image receiving medium such as recording or print paper. As described above, the ink liquid ejected from the ink ejection port can be smoothly transferred by using the intermediate image receiving medium, and the deteriorated image quality due to the unequal quality of the image receiving medium such as print paper can be prevented from being generated.

According to the present invention, the third object can be attained by a recording head for use in the above-mentioned image forming apparatus, wherein plural ink ejection ports are arranged on a straight line which is orthogonal or substantially orthogonal to a relative displacement direction of an image receiving medium.

When the adjacent ink ejection ports are distributed to multiple parallel straight lines which are orthogonal or substantially orthogonal to the relative displacement direction of the image receiving medium, the pixel density can be enhanced.

Since a flow rate (volume flow rate per unit time) of at least one image forming ink, which substantially forms an image after dried out, one of a plurality of inks ejected from one ink ejection port is managed so as not to be constantly zero, a mixture amount of this image forming ink can be always grasped and managed. In this case, since a diffusion range or length of the liquid obtained by natural diffusion of the ink with respect to one pixel is considerably short, it is preferable to determine a flow rate required for refreshing a volumetric capacity to the extent of diffusion as a minimum flow rate. As a result, a fluctuation in color and/or density due to natural diffusion of the ink can be suppressed, thereby forming an image having the high image quality.

DESCRIPTION OF THE PREFERRED EMBODIMENTS

First Embodiment

An embodiment adopted to a continuous coating mode is described hereinafter with reference to FIGS. 1 and 2.

Figure 1:
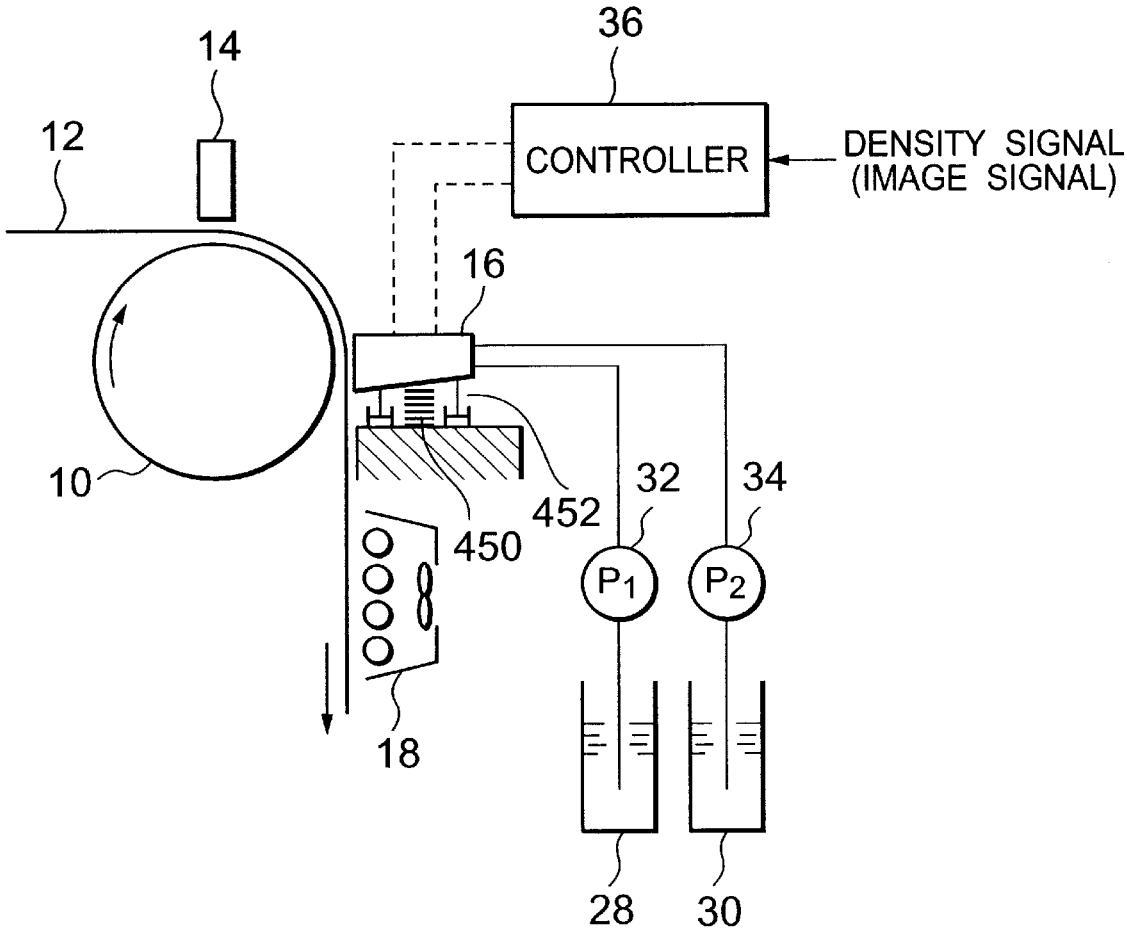
FIG. 1 is a view showing the concept of an image forming apparatus according to a first embodiment of the present invention to which a continuous coating mode is applied.

In FIG. 1, reference numeral 10 designates a platen and 12 denotes a print paper as an image receiving medium wound around the platen 10. The print paper 12 is fed in a direction of an arrowhead at a fixed speed by the illustrative clockwise rotation of the platen 10.

Reference numeral 14 represents an undercoating section for applying a transparent undercoating liquid onto the print paper 12 in order to enhance the adherability of ink to improve the image quality. Reference numeral 16 designates a recording head which serves as an image forming section for forming an image on the print paper 12. First ink and second ink are mixed or combined in the recording head 16 and led to the print paper 12. Reference numeral 18 denotes a heater for heating the print paper 12 on which an image is formed by the image forming section 16 so that the ink is dried out.

Figure 2:
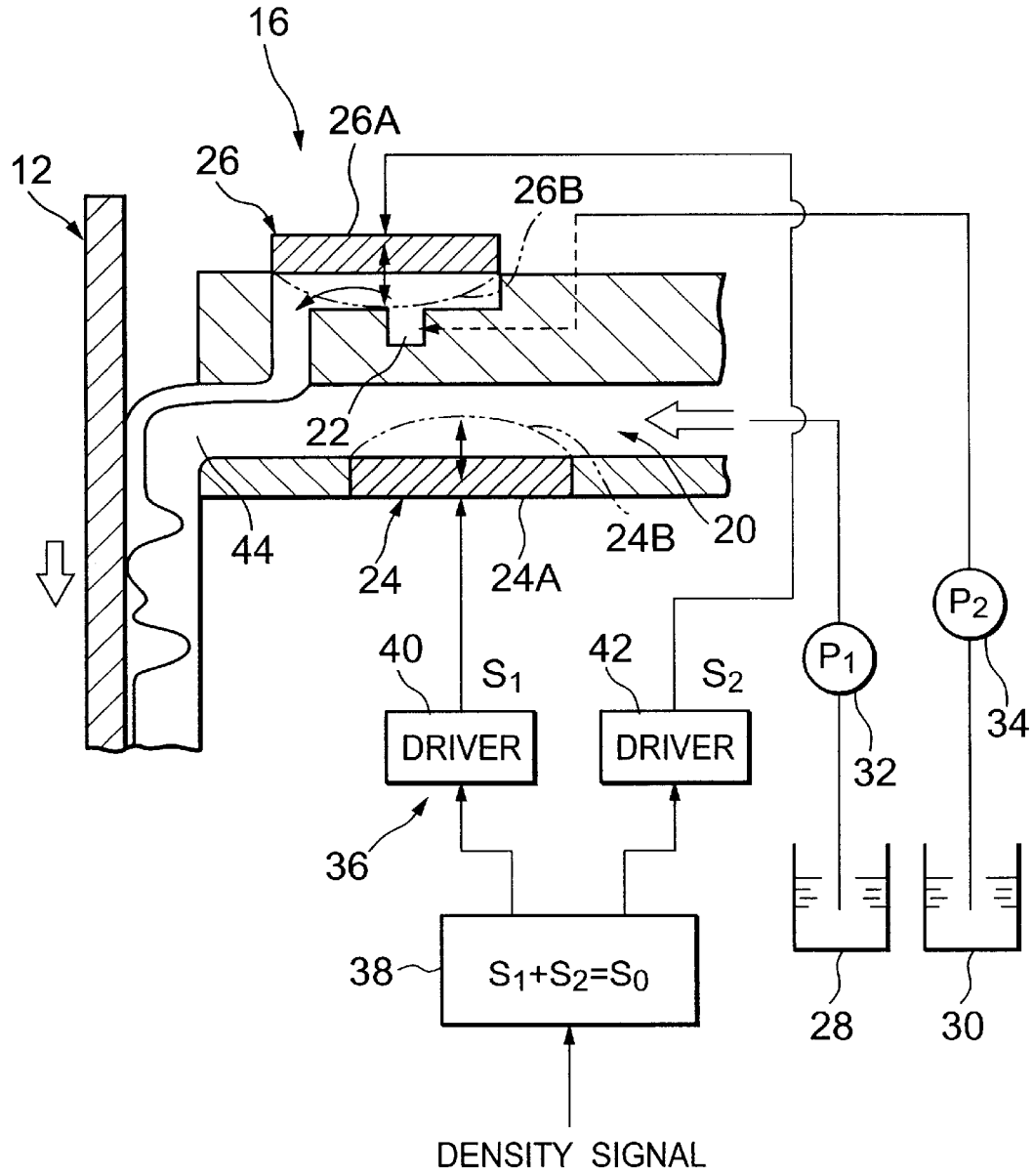
FIG. 2 is an enlarged cross-sectional view of an image forming section (recording head) used in the image forming apparatus illustrated in FIG. 1.

As shown in FIG. 2, the recording head 16 includes: a first ink channel 20; a second ink channel 22; and flow control valves 24 and 26 as ink flow rate controlling means for changing the channel cross section areas of the respective channels 20 and 22. The first ink is an non-forming ink (clear ink), i.e., ink which is transparent and colorless or becomes transparent and colorless when dried out. The first ink contains a discoloration preventing agent such as antioxidant or ultraviolet ray absorber. The second ink is an image forming ink for finally substantially forming an image after dried out, for example, black ink.

The first ink and the second ink are respectively filled in ink tanks 28 and 30, and fed to the first and second ink channels 20 and 22 with a fixed pressure from the ink tanks 28 and 30 by ink feed pumps 32 and 34. As the pumps 32 and 34 used in this example, those having a structure in which a pressure adjusting valve is provided on the ink discharge side (the outlet port side of the pump) to maintain the ejection pressure constant is suitable for example.

Flow control valves 24, 26 include, e.g., piezoelectric devices 24A, 26A and diaphragms 24B, 26B which move into/from the ink channels 20, 22 by the distortion of the devices 24A, 26A, respectively. These piezoelectric devices 24A, 26A are controlled by a controller 36 (FIG. 1) in such a manner that supply amounts $S_1$ and $S_2$ of the first and second ink supplied from the respective ink channels 20 and 22 are controlled.

The controller 36 includes a processor 38 and drivers 40, 42 as shown in FIG. 2. The processor 38 calculates a mixture proportion of the first and second inks ($S_1/S_2$) based on a density signal (image signal). Here, the supply amount $S_2$ of the second black ink is controlled so as not to be zero. When the supply amounts $S_1$ and $S_2$ of the first and second inks are determined so that the sum ($S_1/S_2$) becomes a fixed amount $S_0$, the flow of the ink fluid is stabilized and a turbulence or a whirlpool is not generated as will be described later, thereby enabling stable formation of an image. The drivers 40 and 42 drive the piezoelectric devices 24A and 26A in order that the supply amounts from the respective channels 20 and 22 become $S_1$ and $S_2$.

For example, the piezoelectric devices 24A and 26A are driven by a pulse having a mechanical resonance frequency inherent to the device, and the pulse number controls a number of times of opening/closing the diaphragms 24B and 26B, thereby controlling flow rate $S_1$ and $S_2$. In this case, if the channel resistance of the ink channels 20, 22, the ink feed pressure, a condition for opening/closing the diaphragms 24B, 26B and others are satisfied, a total flow rate $S_0=S_1+S_2$ can be managed to be constant by controlling in such a manner that a sum of the pulse number for driving the piezoelectric devices 24A, 26A becomes a fixed value.

A minimum supply amount $S_{20}$ of the second ink supply amount $S_2$ is set in such a manner that a change in optical density of the ink liquid due to addition of this ink becomes not more than 0.1 for example. That is because a change in density of all-white portion (the background portion and the like) in an image can be suppressed to the extent that the visual identification is hard by doing so. Incidentally, even in case of all white, a density tone is corrected in the processor 38 of the controller 36 in accordance with addition of a small amount (minimum supply amount) $S_{20}$ of the second ink supply amount $S_2$ if necessary.

The first and second ink whose flow rate is controlled are ejected as a continuous flow from an ink ejection port 44 at which the first and second channels 20 and 22 become confluent and continuously applied on the print paper 12 opposed to the ink ejection port 44 in contiguity therewith. In this case, the first ink and the second ink are applied as a layer or laminar flow having no turbulence without being mixed with each other as shown in FIG. 2. Here, the layered flow includes a flow which is mixed only in the vicinity of a border between the first and second ink. Although the first ink and the second ink may be uniformly mixed, the surface of an image formed on the print paper 12 can be covered with any of these types of ink (the first ink in this example) by providing the layer flow in this manner. When any of these types of ink (the second ink in this example) is an ink having conformability to the undercoating layer on the print paper 12, the image quality can be improved.

When a plurality of sets of the first and second ink channels 20, 22 and the flow control valves 24, 26 are provided to be aligned in a direction of the width of the print paper (a direction orthogonal to the moving direction of the print paper) and they are provided in accordance with respective pixels, an image can be formed by controlling the flow control valves 24, 26 for the respective pixels based on the density signal (image signal). In such a case, the ink ejection port 44 can be independently opposed to and facing to the print paper 12 in accordance with each pixel. Further, these ink ejection ports 44 can be formed in the slot-shaped opening elongating in the width direction of the print paper 12, and the ink liquid constituted by the first and second inks can be zonally transported and applied onto the print paper 12 from this slot opening.

Second Embodiment

Figure 3:
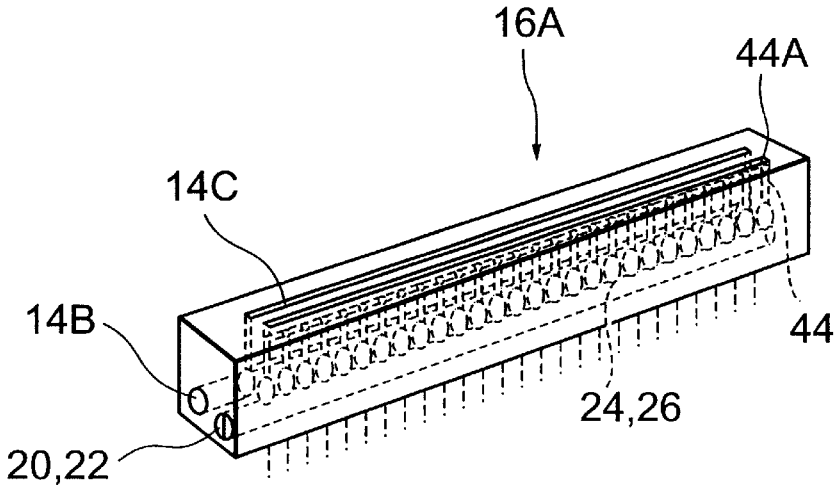
FIG. 3 is a perspective view showing an image forming section (recording head) for zonally transporting an ink to print paper according to a second embodiment of the present invention.

FIG. 3 is a perspective view showing an image forming section (recording head) 16A used in a second embodiment for performing continuous zonal application as described above, and FIG. 4 is an enlarged cross-sectional view showing the state of application. The recording head 16A includes ink ejection ports 44 which are independent in accordance with respective pixels and a slot opening 44A which is in parallel with the ink ejection ports 44 for the respective pixels, and the ink liquid continuously ejected from each ink ejection port 44 zonally congregates as a layer flow in the slot opening 44A to be ejected or extruded on the print paper 12.

The undercoating section 14A is integrally incorporated in the recording head 16A. The undercoating section 14A includes an undercoating liquid channel 14B which is parallel to the first and second ink channels 20, 22 and a slot opening 14C which is parallel to the slot 44A. Since an undercoating liquid L is transparent and colorless and used for the preliminary treatment in order that the ink liquid can stably adhere to the surface of the print paper 12, it is positioned on the upstream side of the slot 44A of the recording head 16A with respect to the moving direction of the print paper 12.

Figure 4:
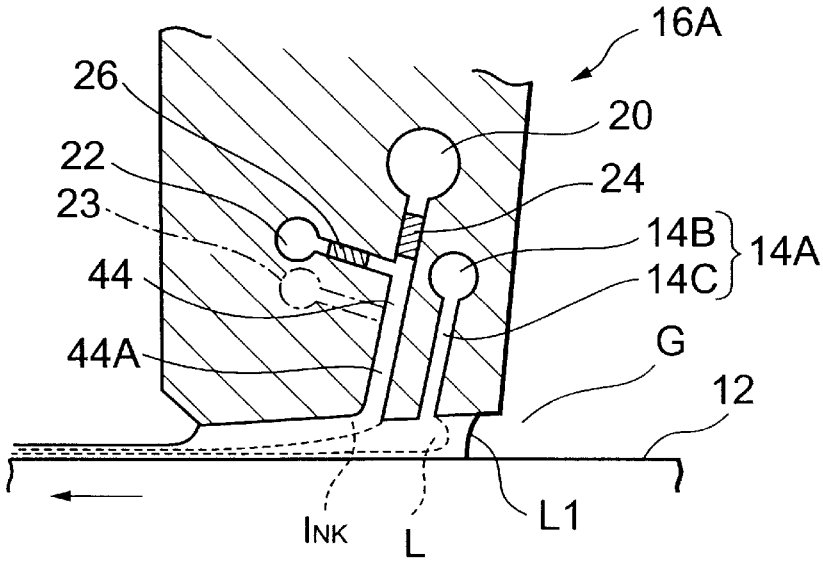
FIG. 4 is an enlarged cross-sectional view showing a state of coating applied by a recording head illustrated in FIG. 3.

The undercoating liquid L has a function for preventing turbulence or a whirlpool in the flow of an ink liquid $I_{NK}$ when continuously applying the ink liquid $I_{NK}$ from being generated and improving the image quality. Specifically, as shown in FIG. 4, a part of the undercoating liquid L which has been just ejected from the slot 14C flows to the upstream side of the slot 14C to form a liquid pool or bead L1 in a gap G formed between the recording head 16A and the print paper 12. A whirlpool of the undercoating liquid L may be generated in the liquid pool L1, but this does not adversely affect the coating surface because the undercoating liquid L is transparent.

The undercoating liquid L comes in front of the slot 44A as a stable layer flow having a fixed thickness in consequence with movement of the print paper 12. Accordingly, the ink liquid $I_{NK}$ ejected from the slot 44A is loaded onto the layer flow of the undercoating liquid L to be applied. Therefore, the image quality can be improved without generating a distortion or a whirlpool in the flow of the ink liquid $I_{NK}$.

A third ink channel 23 may be provided to the recording head 16A. Third ink supplied from the third ink channel 23 is led to the ink ejection port 44 through the flow control valve (not shown) and transported to the print paper 12 together with the first and second ink. When providing the third ink channel 23, color ink having colors of yellow, magenta and cyan is supplied to the first, second and third ink channels 20, 22 and 23, respectively, and a mixture ratio of the color inks is varied, thus enabling formation of a color image.

Third Embodiment

Figure 5:
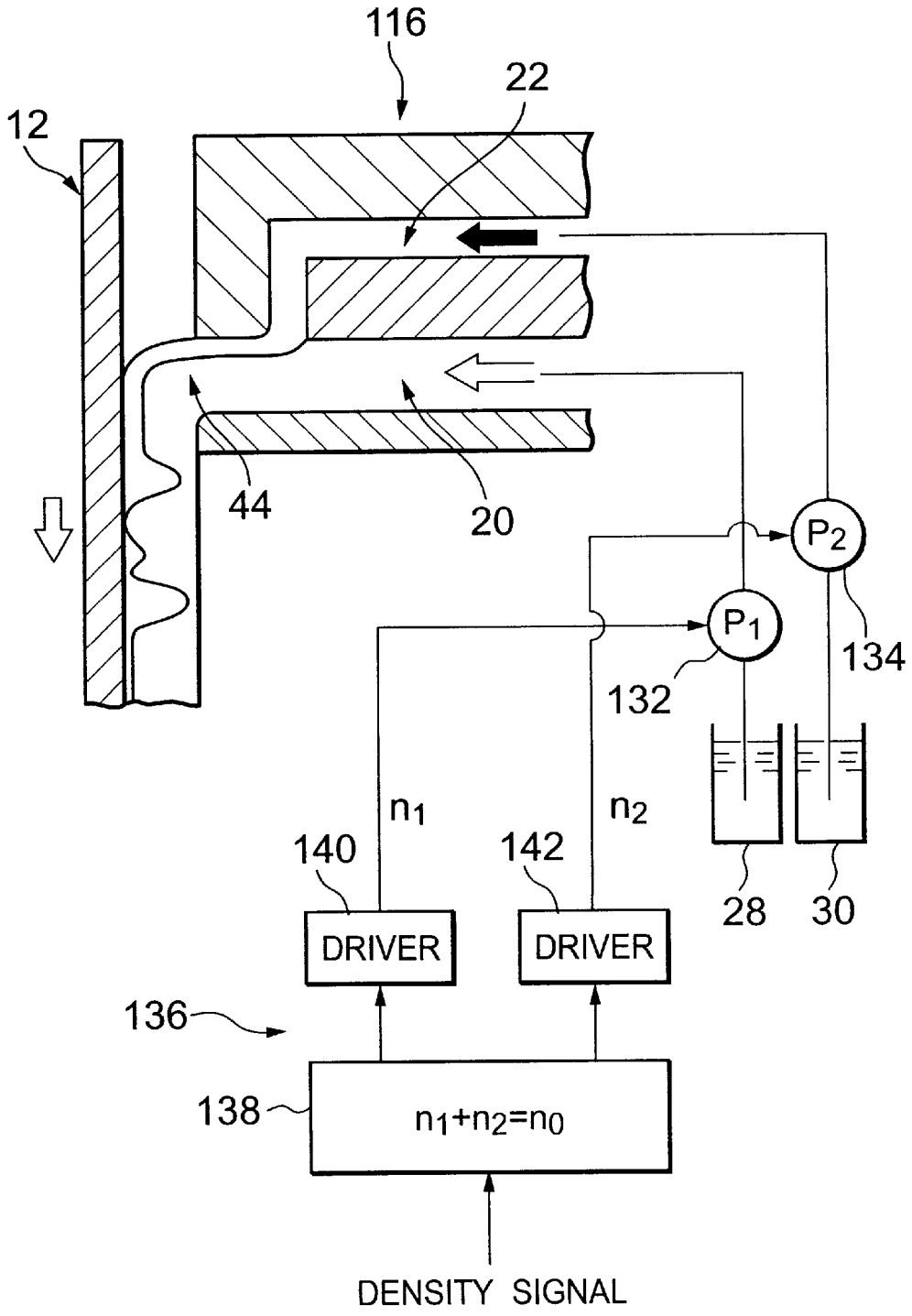
FIG. 5 is a cross-sectional view showing an image forming section (recording head) according to a third embodiment.

FIG. 5 is a cross-sectional view showing an image forming section (recording head) 116 according to a third embodiment. The recording head 116 controls a quantity of flow of ink supplied to the first and second ink channels 20, 22 by changing the discharge quantity of ink feed pumps 132, 134, in place of using the flow control valves 24, 26 described with reference to FIGS. 1 to 4.

The pumps 132, 134 are of a volumetric capacity type having a discharge quantity proportional to an amount of rotation. For example, a pump for squeezing a flexible tube appressed against the inner surface of a circular case from the inner peripheral side by an eccentric in a defined direction is suitable. The pumps 132, 134 are driven by a pulse motor (stepping motor). A quantity of rotation of this motor can be controlled by a driving pulse number and, as a result, a discharge quantity of the ink from the pumps 132, 134 can be controlled.

A controller 136 is made up of a processor 138 and drivers 140, 142. The processor 138 determines a mixture proportion of the first and second ink based on a density signal (image signal) and calculates pulse numbers $n_1$, and $n_2$ corresponding to the proportion of mixture. The pulse numbers $n_1$ and $n_2$ are to be fed to the motor for each of the pumps 132, 134, respectively. The drivers 140, 142 sends the driving pulses having pulse numbers $n_1$, $n_2$ to the respective motors to actuate the pumps 132, 134. Consequently, predetermined amounts of the first and second ink are supplied to the first and second ink channels 20, 22, and they are transported or transferred as a fixed flow rate of the ink liquid from the ink ejection port 44 to the print paper 12. In this case, a sum of amounts of ejected ink is adjusted to be always constant in such a manner $n_1+n_2$ becomes a fixed value $n_0$.

Fourth Embodiment

Figure 6:
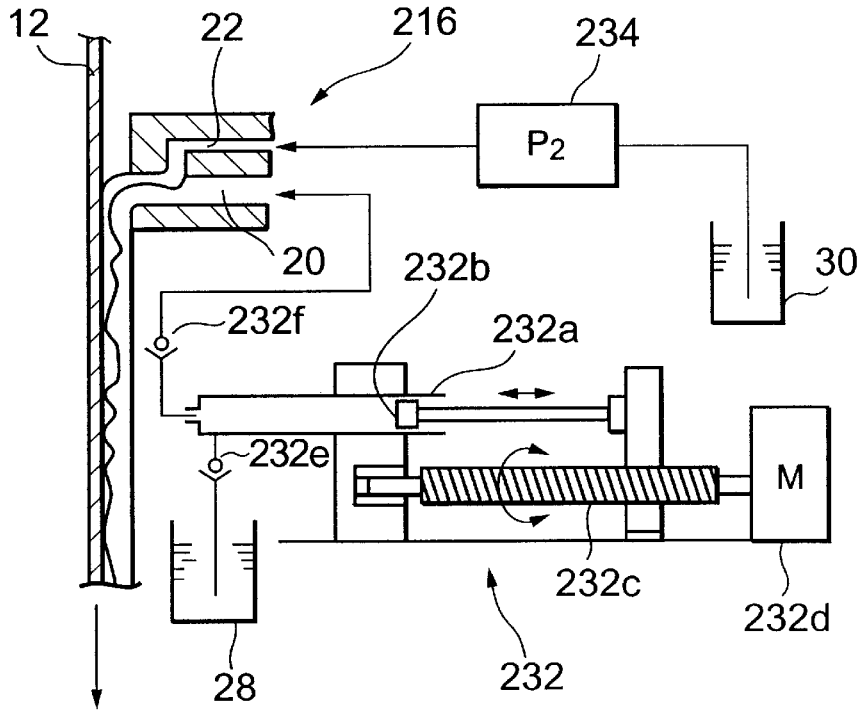
FIG. 6 is a cross-sectional view showing an image forming section (recording head) according to a fourth embodiment.

FIG. 6 is a cross-sectional view showing an image forming section (recording head) according to a fourth embodiment. In this embodiment, ink feed pumps 232, 234 for feeding the first and second ink are formed by cylinder pumps. It is to be noted that the pumps 232, 234 have the same structure and hence only one pump 232 will be explained.

The cylinder pump 232 includes a cylinder 232*a,* a piston 232*b,* a feed screw 232*c* for pushing/pulling the piston 232*b,* and a pulse motor 232*d* for driving to rotate the feed screw 232*c.* The piston 232*b* is pushed and pulled in the cylinder 232*a* by the normal/reverse rotation of the motor 232*d.* The first ink is sucked in the cylinder 232*a* from the ink tank 28 through a one-way valve 232*e* in connection with the movement of the piston 232*b,* and the ink is fed to the first ink channel 20 through the one-way valve 232*f* in concurrence with the movement of the piston 232*b.*

A quantity of movement of the piston 232*b* is proportional to a quantity of rotation of the motor 232*d.* The piston 232*b* is fully moved in a direction of recession before forming an image on one page, and the first ink is sufficiently sucked in the cylinder 232*a.* Thereafter, the motor 232*d* is rotated by a quantity of rotation corresponding to the density signal to move the piston 232*b* in a direction of ingress by only a predetermined quantity of movement, thereby feeding a predetermined amount of the first ink to the ink channel 20. The motor 232*d* can be driven by a controller 136 similar to that in the embodiment illustrated in FIG. 5.

Fifth Embodiment

Figure 7:
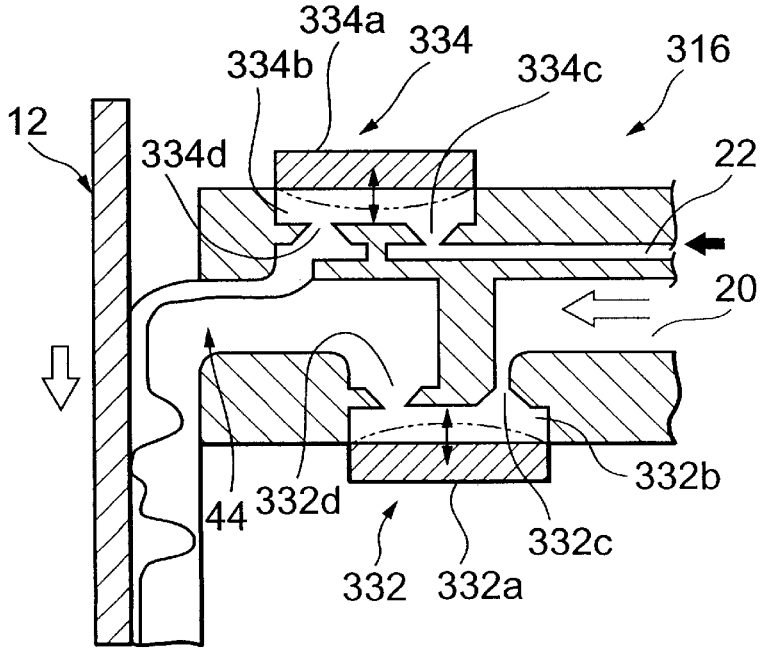
FIG. 7 is a cross-sectional view showing an image forming section (recording head) according to a fifth embodiment.

FIG. 7 is a cross-sectional view showing an image forming section 316 (recording head) according to a fifth embodiment. In this embodiment, ink feed pumps 332, 334 using the piezoelectric devices are used in place of the ink feed pumps 132, 134 in FIG. 5 and 232, 234 in FIG. 6. The pumps 332, 334 include: piezoelectric devices 332*a,* 334*a;* cavities 332*b,* 334*b* using each of the piezoelectric devices 332*a,* 334*a* as one wall surface; inlets 332*c,* 334*c* having such a shape as that a conductance (inverse number of the resistance) varies with respect to the cavities 332*b,* 334*b* in accordance with a direction of a flow of the ink; and outlets 332*d,* 334*d,* respectively. Here, it is desirable that any surface treatment is applied or a protection layer is provided on a surface of each of the piezoelectric devices 332*a,* 334*a* with which the cavities 332*b,* 334*b* come into contact.

Accordingly, when the piezoelectric devices 332*a,* 334*a* are driven to be deformed, volumetric capacities of the cavities 332*b,* 334*b* vary, and the ink flows from the inlets 332*c,* 334*c* toward the outlets 332*d,* 334*d.* The piezoelectric devices 332*a,* 334*a* are driven by a pulse voltage having a mechanical resonance frequency for each device. Therefore, controlling the pulse number for driving each of the piezoelectric devices 332*a* and 334*a* enables control of quantities of supply of the first and second ink. In this case, a controller similar to the controller 36 shown in FIG. 2 can be used.

Sixth to Tenth Embodiments

Figure 8:
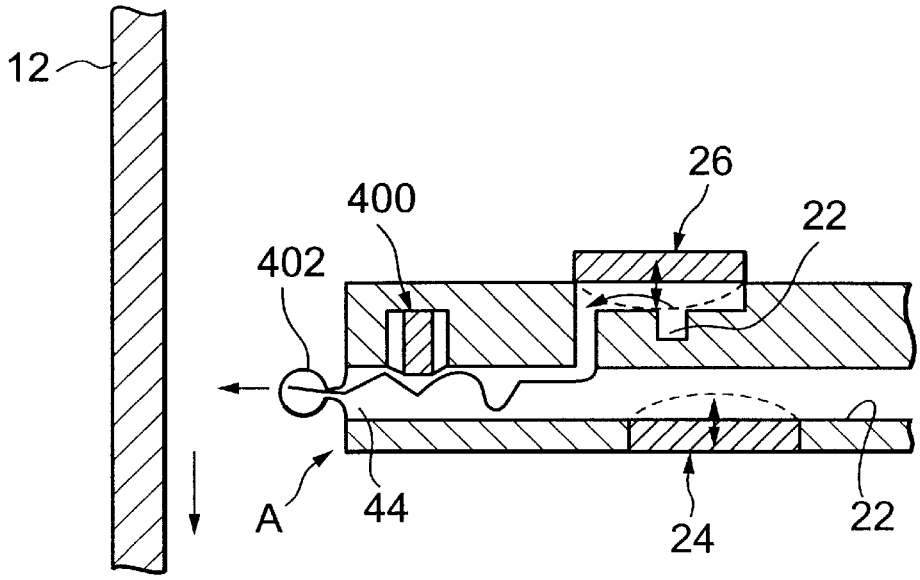
FIG. 8 is a cross-sectional view showing an image forming section (recording head) according to a sixth embodiment having ink transporting means to which a piezo ink jet mode is applied.
Figure 9:
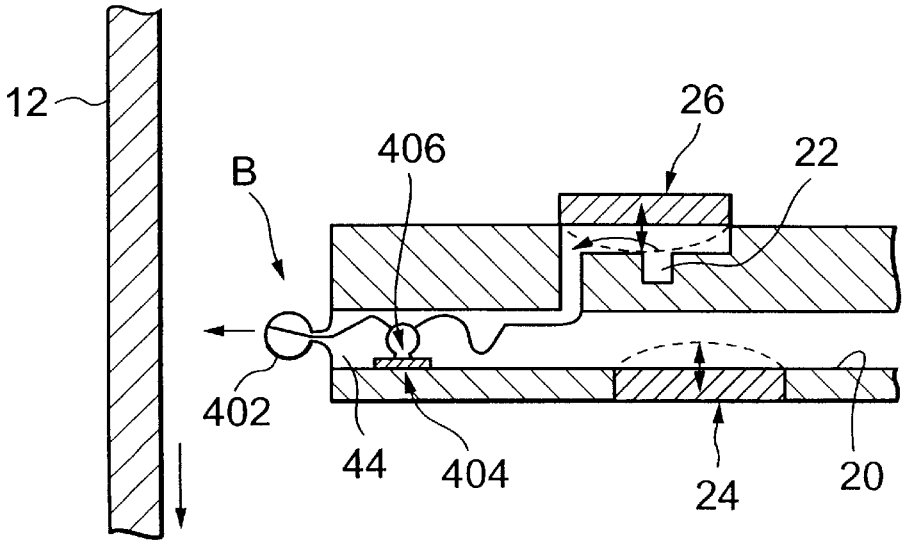
FIG. 9 is a cross-sectional view showing an image forming section (recording head) according to a seventh embodiment having ink transporting means to which a thermal ink jet mode is applied.
Figure 10:
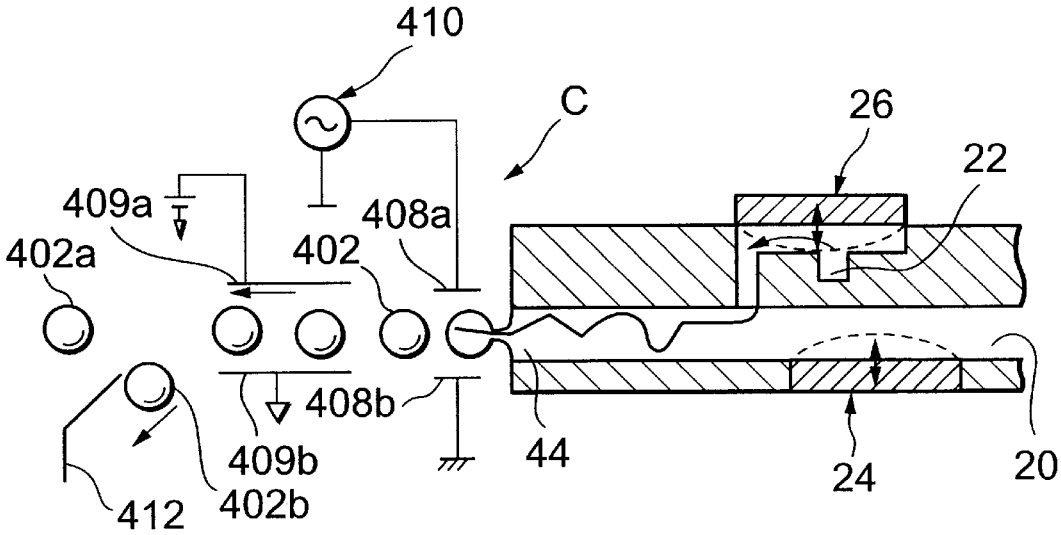
FIG. 10 is a cross-sectional view showing an image forming section (recording head) according to an eighth embodiment having ink transporting means to which a continuous ink jet mode is applied.
Figure 11:
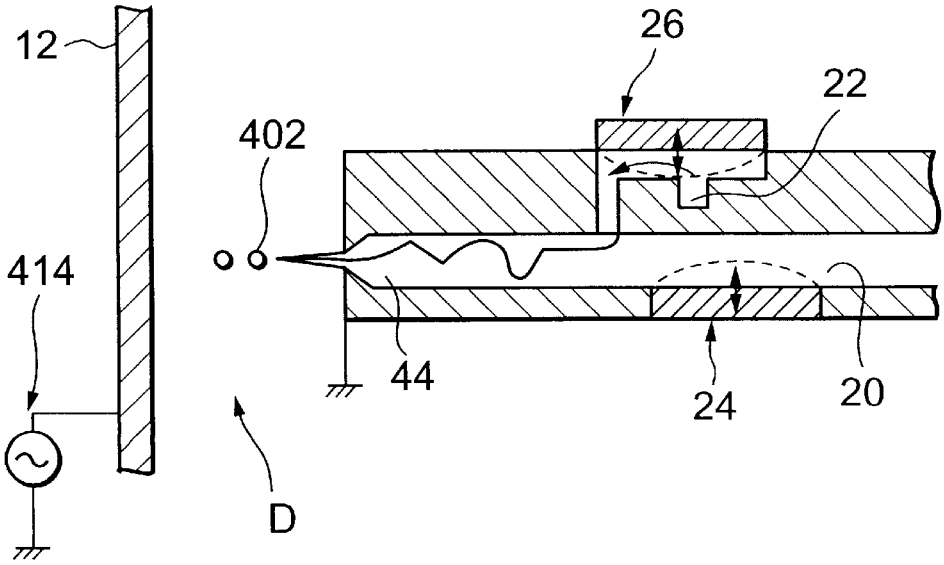
FIG. 11 is a cross-sectional view showing an image forming section (recording head) according to a ninth embodiment having ink transporting means to which an electrostatic attraction ink jet mode is applied.
Figure 12:
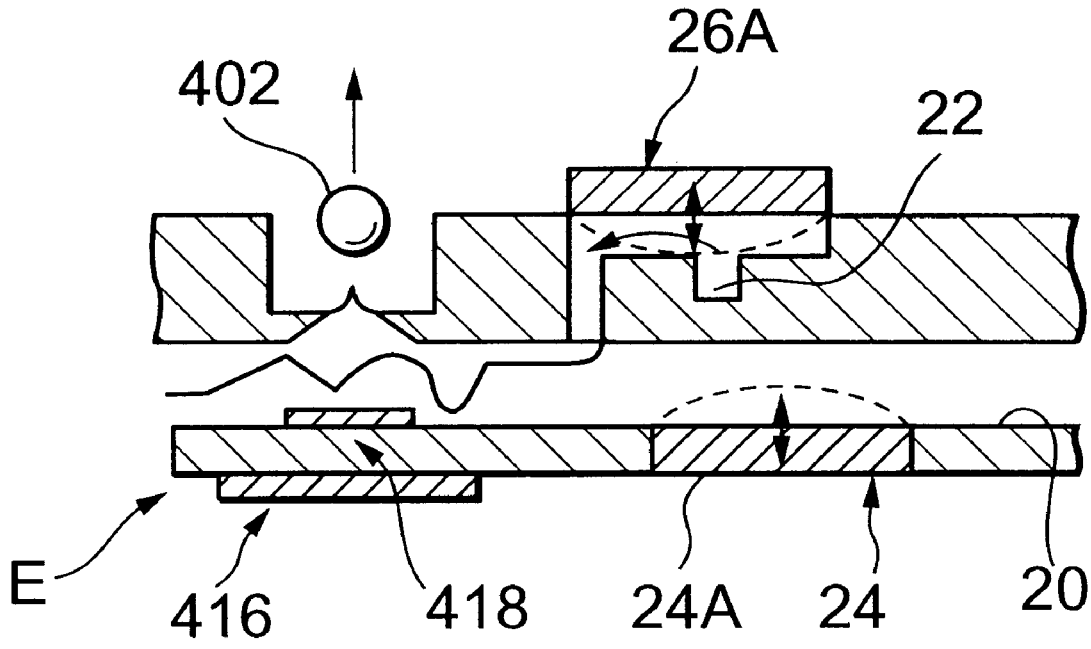
FIG. 12 is a cross-sectional view showing an image forming section (recording head) according to a tenth embodiment having ink transporting means to which an ultrasonic ink jet mode is applied.

FIGS. 8 to 12 show each image forming section having ink transporting means according to sixth to tenth embodiments, respectively. FIG. 8 illustrates a piezo ink jet mode; FIG. 9, a thermal ink jet mode; FIG. 10, a continuous ink jet mode; FIG. 11, an electrostatic attraction ink jet mode; and FIG. 12, an ultrasonic ink jet mode.

In these embodiments, the first and second inks controlled by the flow control valves 24, 26 using the piezoelectric devices 24A, 26A, respectively, similar to those shown in FIG. 2 are led to the ink ejection port 44. The ink transporting means A in FIG. 8 ejects or jets the ink as a droplet 402 by using a piezoelectric ejection device 400 provided in the vicinity of the ink ejection port 44 and leads it onto the print paper 12.

The ink transporting means B in FIG. 9 generates a bubble 406 by heating the ink liquid by a heater 404 provided in the vicinity of the ink ejection port 44 in order to eject or jet an ink droplet 402. In the ink transporting means C in FIG. 10, a high voltage according to the image signal is applied between electrodes 408 (408*a,* 408*b*) provided before the ink ejection port 44 by an oscillator 410. As a result, an electric charge in accordance with the image signal is imparted to the ink droplet 402 drawn from the ink ejection port 44. The ink droplet is deflected by deflecting electrodes 409 (409*a,* 409*b*) so that only a necessary droplet 402*a* is led to the print paper 12 while removing an unnecessary droplet 402*b* by a baffle plate 412.

The ink transporting means D in FIG. 11 narrows down the ink ejection port 44 to a small diameter and applies a high voltage associated with the image signal between the ink ejection port 44 and the print paper 12 by an oscillator 414. The high voltage is used to draw the ink droplet 402 from the ink ejection port 44 so that the ink droplet 402 is attracted on the print paper 12. In the ink transporting means E illustrated in FIG. 12, an ultrasonic transducer 416 is provided on the outer wall of the ink ejection port 44, and the ultrasonic wave emitted from the ultrasonic transducer 416 is converged on the ink liquid by a Fresnel lens 418 provided on the inner wall of the ink ejection port 44 to excite the ink liquid so that the droplet 402 is generated.

When the inks are mixed with each other by natural diffusion between the inks at a confluence of a plurality of inks and a vibration occurs in the confluence or a vibration or a turbulence is generated in the ink flow, a turbulence is produced on the contact interface of the inks due to these disturbances, thereby facilitating mixture of the inks. Therefore, a minimum addition amount of the ink which is not transparent and colorless must be increased, which may result in restriction of the density tone or degradation of the image quality.

Thus, it is preferable to provide a vibration absorption mechanism at the confluence of the inks. For example, the image forming section (recording head) 16 can be supported by an antivibration spring 450 or an attenuator 452 as shown in FIG. 1. Further, in order to suppress the pulse of the ink or the vibration of the flow control valves 24, 26, it is desirable to additionally provide a damper for absorbing the ink pulses or to adopt the flow control valves 24 and 26 which are of the vibration absorbing type.

In the foregoing first to tenth embodiments explained in connection with FIGS. 1 to 12, since two types of ink are mixed or combined and one of them is transparent and colorless ink, an image can be formed by changing the density. However, in the present invention, the color and the density can be simultaneously changed by mixing multiple types of ink having colors of, e.g., yellow, magenta, cyan and black or mixing these types of ink with the transparent and colorless ink. Instead of using the image forming section 16 which forms an image directly on the image receiving medium such as the print paper 12, an image may be formed temporarily on an intermediate image receiving medium such an intermediate transfer drum so that the image can be transferred from the intermediate image receiving medium to a final image receiving medium such as print paper may be used.

Eleventh Embodiment

Figure 13:
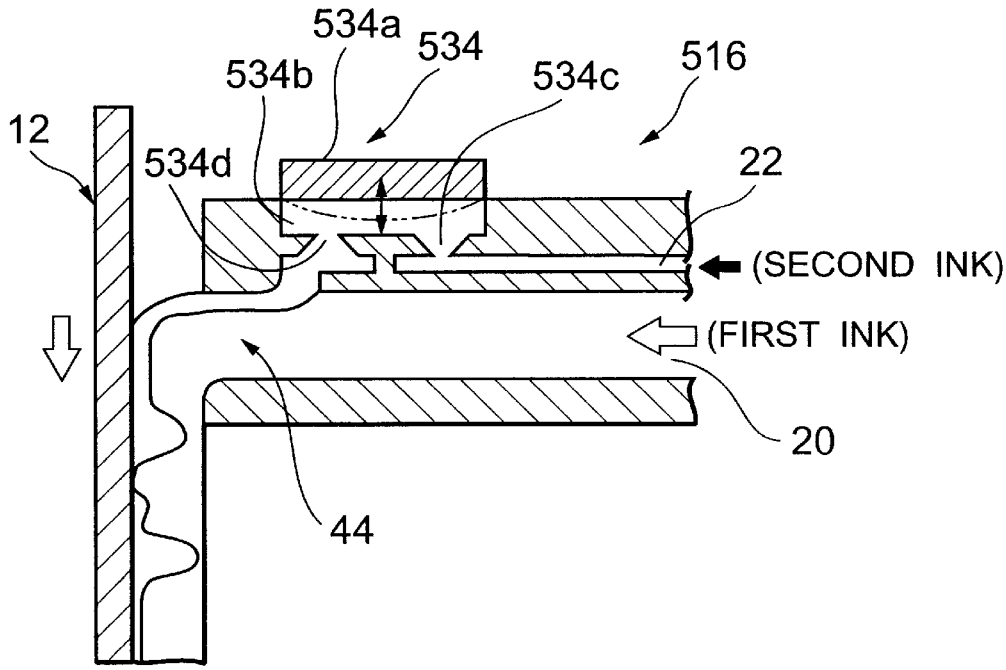
FIG. 13 is a cross-sectional view showing an image forming section (recording head) according to an eleventh embodiment to which a continuous coating mode is applied.

FIG. 13 is a cross-sectional view showing an image forming section (recording head) 516 according to an eleventh embodiment adopting a continuous coating mode. This embodiment employs an ink feed pump 534 driven by the piezoelectric device in place of the ink feed pump 234 formed by the cylinder pump in the recording head 216 shown in FIG. 6.

This ink feed pump 534 is constituted as similar to the ink feed pump 334 illustrated in FIG. 7. That is, a cavity 534*b* and check valves 534*c* and 534*d* which are positioned before and after the cavity 534*b* are provided to the second ink channel 22, and a diaphragm which is driven by a piezoelectric device 534*a* or a diaphragm which is integral with the piezoelectric device 534*a* is used to change a volumetric capacity of the cavity 534*b*.

Twelfth Embodiment

Figure 14:
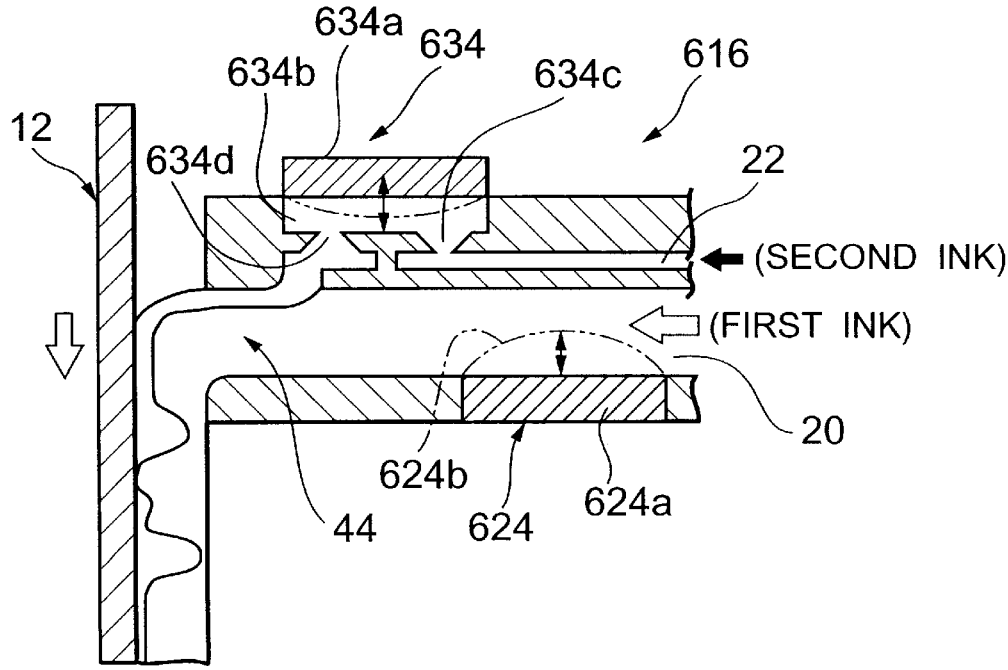
FIG. 14 is a cross-sectional view showing an image forming section (recording head) according to a twelfth embodiment to which the continuous coating mode is applied.

FIG. 14 is a cross-sectional view showing an image forming section (recording head) 616 according to a twelfth embodiment similarly adopting the continuous coating mode. This embodiment uses an ink feed pump 634 instead of the flow control valve 26 in the recording head 16 shown in FIG. 2.

The first ink is supplied to the first ink channel 20 with a fixed pressure by a non-illustrated pump, and a quantity of flow of the first ink is controlled by a flow control valve 624 provided to the first ink channel 20. The effective section area of the ink channel in the flow control valve 624 is controlled by displacement of a diaphragm 624*b* driven by a piezoelectric device 624*a*. An ink feed pump 634 provided to the second ink channel 22 has a piezoelectric device 634*a*, a cavity 634*b*, and check valves 634*c*, 634*d*.

Thirteenth Embodiment

Figure 15:
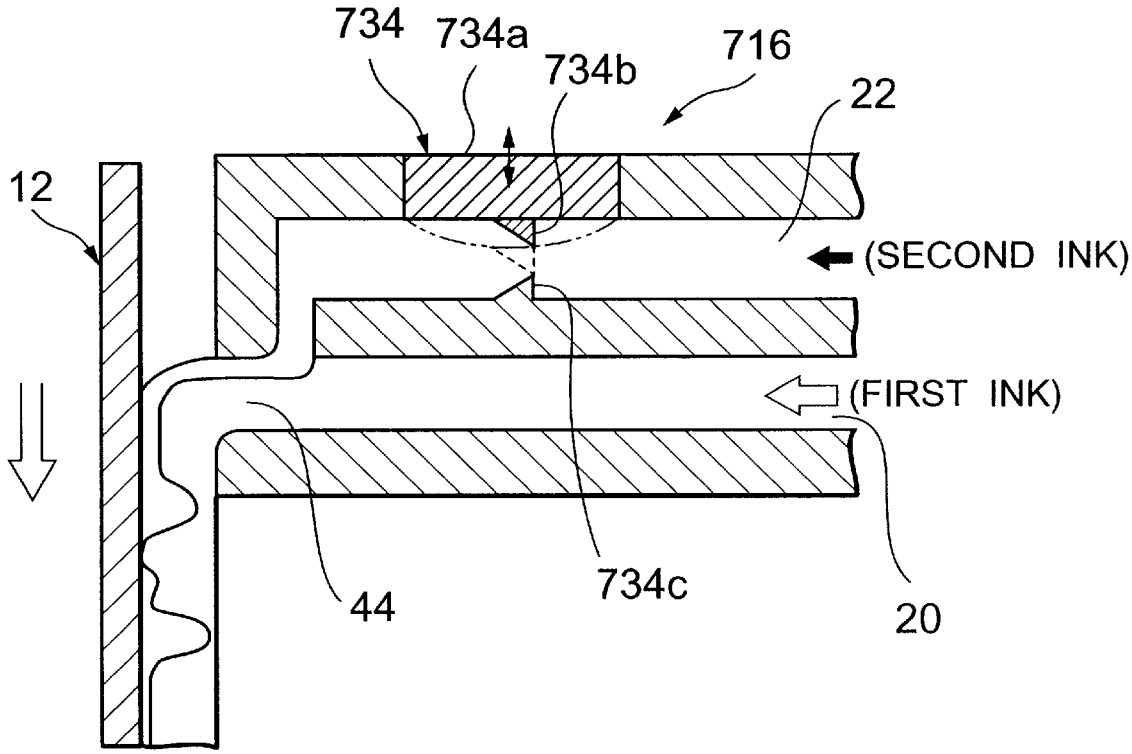
FIG. 15 is a cross-sectional view showing an image forming section (recording head) according to a thirteenth embodiment to which the continuous coating mode is applied.

FIG. 15 is a cross-sectional view showing an image forming section (recording head) 716 according to a thirteenth embodiment similarly adopting the continuous coating mode. In this embodiment, an ink feed pump 734 substitutes for the ink feed pump 234 formed by the cylinder pump in the image forming section 216 illustrated in FIG. 6.

The ink feed pump 734 includes a piezoelectric device 734*a* facing to the second ink channel 22, and a pair of wedgeshaped protrusions 734*b*, 734*c* opposing to each other. The protrusion 734*b* is disposed on the piezoelectric device 734*a* and the other protrusion 734*c* is disposed to the inner wall of the ink channel 22 opposed to the piezoelectric device 734*a*. The protrusions 734*b*, 734*c* have inclined surfaces extending each other toward a direction of a flow of the ink. The vibration of the piezoelectric device 734*a* causes ingress/regress of the protrusion 734*b* in the ink channel 22. Consequently, the ink sandwiched between the inclined surfaces of the protrusions 734*b*, 734*c* is pushed out in a direction of the ink ejection port 44. Therefore, a quantity of ejection of the second ink is controlled by a number of vibration and amplitude of the piezoelectric device 734*a*.

Structure of Check Valve

Figure 16:
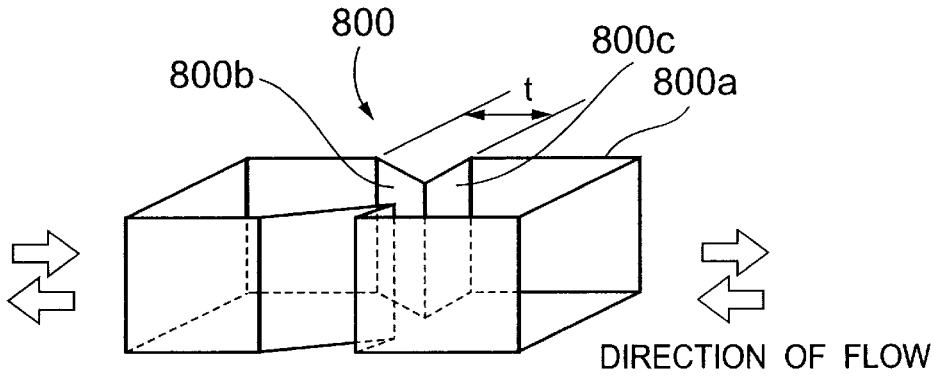
FIGS. 16 to 18 are perspective views showing various structures of a check valve used in ink feed pumps 334, 434 and 634 illustrated in FIGS. 7, 13 and 14.
Figure 17:
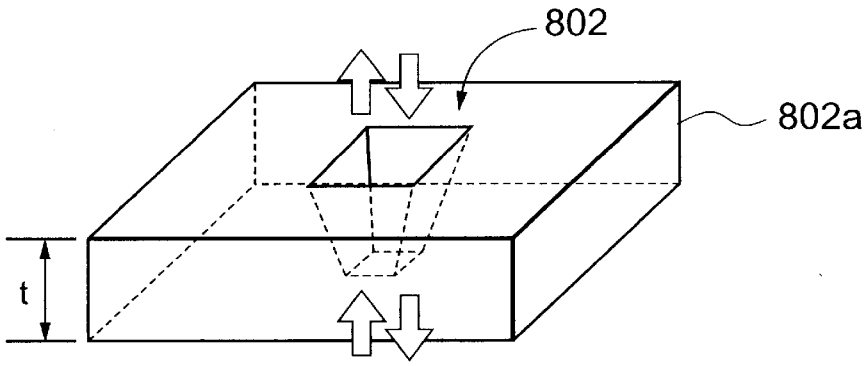
Figure 18:
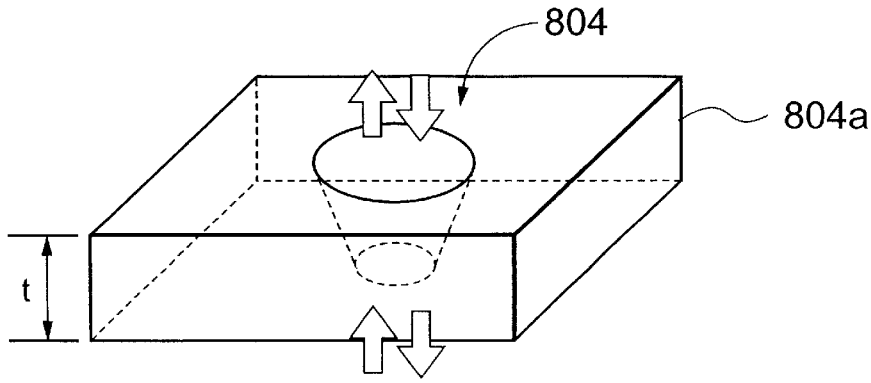

FIGS. 16, 17 and 18 are perspective views showing different structures of a check valve, and FIG. 19 is detailed explanatory drawings of these structures. Check valves 800, 802 and 804 illustrated in the drawings are used in the ink feed pumps 334 (FIG. 7), 534 (FIG. 13) and 634 (FIG. 14) depicted in FIGS. 7, 13 and 14. Each of these check valves 800, 802 and 804 is a restriction or restrictor having such a geometrical shape as that the resistance relative to a flow direction of the ink becomes larger than the resistance relative to its reverse direction. Therefore, each check valve has no movable portion and can be readily produced by a method for manufacturing a micro-machine.

The check valve 800 shown in FIG. 16 has a substrate 800*a*, an inclined surface 800*b* whose ink channel section area substantially-continuously increases from the right side toward the left side of the substrate 800*a*, and a flat surface 800*c* whose ink channel section area rapidly increases in the reverse direction.

When a cavity whose volumetric capacity varies is provided in the vicinity of the check valve 800, the ink reciprocates through the check valve 800 by a fluctuation in the volumetric capacity of the cavity. In such a case, the resistance becomes small when the ink flows toward the left-hand-side direction in FIG. 16, and the resistance becomes large when the same flows toward the reverse direction (the right-hand-side direction). Therefore, a fluctuation in the volumetric capacity of the cavity causes the ink to flow in a direction with which the resistance becomes small (the left-hand-side direction in the drawing), and the cavity functions as the check valve.

The check valve 802 shown in FIG. 17 uses a quadrangular-pyramid-shaped restriction formed on a substrate 802*a*. The check valve 804 illustrated in FIG. 18 uses a conical aperture restriction formed on a substrate 804*a*. These check valves 802 and 804 function as similar to the check valve 800 depicted in FIG. 16.

Figure 19A:
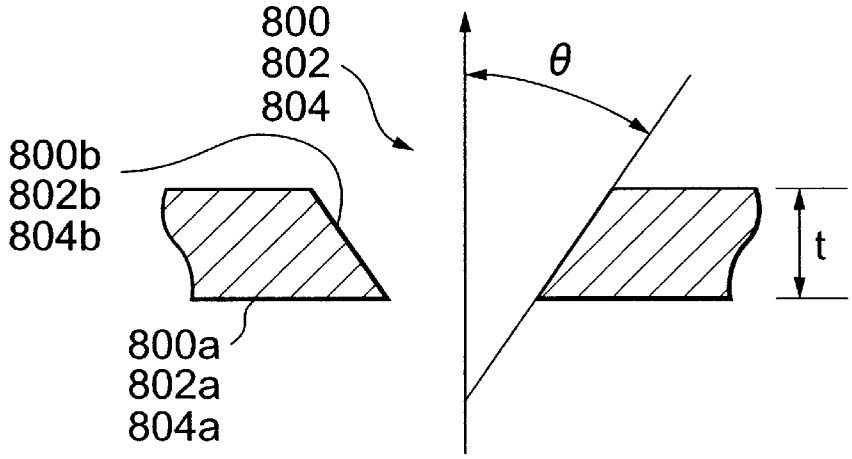
FIG. 19A is an explanatory drawing showing a detailed structure of the check valve illustrated in FIGS. 16 to 18.

These check valves 800, 802 and 804 have a detailed structure shown in FIG. 19A. In FIG. 19A, an inclination $\theta$ of an inclined surface 800*b* of the check valve 800 should be appropriately determined in accordance with the relationship to a length t of a component (which will be simply referred to as a thickness hereinafter) with respect to an ink flow direction on the inclined surface 800*b* of the substrate 800*a*. Also, the inclinations $\theta$ of pyramidal and conical surfaces 802*b* and 804*b* of the check valves 802 and 804 and is determined in accordance with the relationship to thicknesses t of 802 and 804*a*, respectively.

The experiment has revealed that the flow resistance or fluid resistance to the upward direction in FIG. 19A is smaller than the flow resistance to the downward direction when the inclination $\theta$ is set in a range of $2° < \theta < 15°$, and the fluid flows upwards. Further, it was found that the flow or fluid resistance to the upward is larger than the downward flow resistance when the inclination $\theta$ is set in the range of $20° < \theta < 70°$, and the fluid flows downwards. When the flowing direction changes in accordance with the angle $\theta$ of the restriction, the angle $\theta$ must be appropriately determined.

Figure 19B:
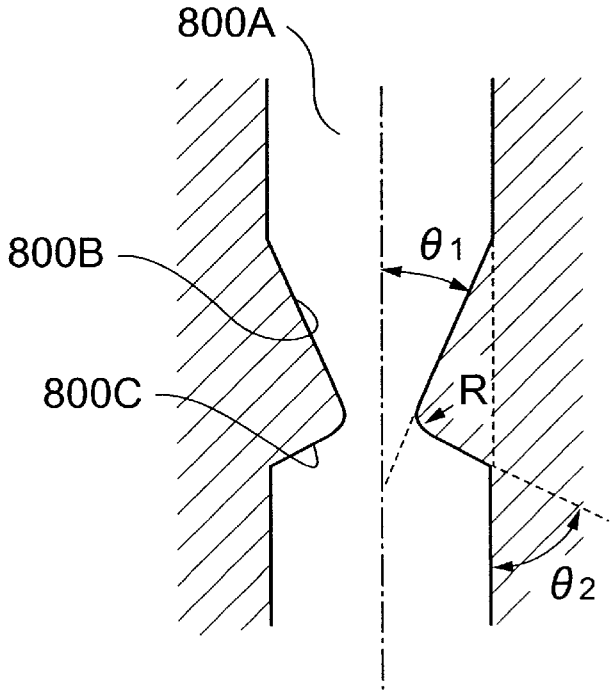
FIG. 19B is an explanatory drawing showing another detailed structure of the check valve.

Further, FIG. 19B shows another detailed structure of the check valve. This check valve 800A connects two conical surfaces 800B, 800C with each other and, when it is assumed that angles defined by the both conical surfaces 800B, 800C and a central line are $\theta_1$, $\theta_2$, respectively, it is understood that the angle $\theta_2$ is set so as to be larger than at least the angle $\theta_1$ ($\theta_2 > \theta_1$) and the angle $\theta$ is preferably not less than 80° and most preferably approximately 90°.

If the angle $\theta_2$ is greatly larger than 90°, air bubbles undesirably adhere to the conical surface 800C and accumulate when the liquid flows from the upper side toward the down side in the FIG. 19B. Incidentally, it has been revealed that the function as the check valve prominently lowers when the angle $\theta_2$ is not more than 60°. When a connection portion between the both conical surfaces 800B and 800C is formed into an appropriate arc-like curved surface as shown by R in the drawing, a flow of the fluid can be further smoothed, which is more desirable.

Arrangement of Recording Head

Figure 20:
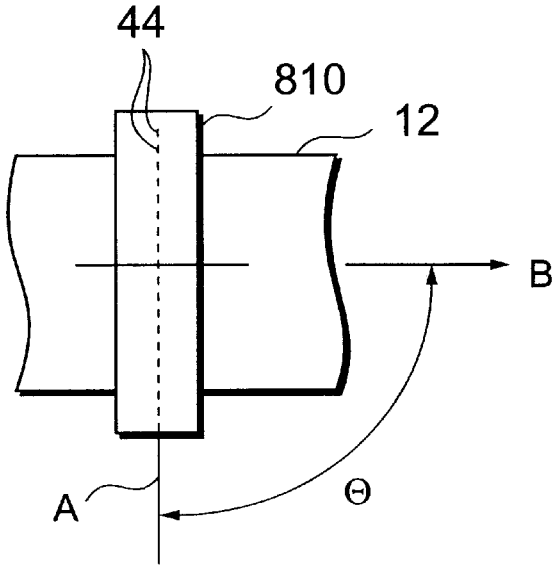
FIG. 20 is a view showing an example of arrangement of the image forming section (recording head) with respect to an image receiving medium.
Figure 21:
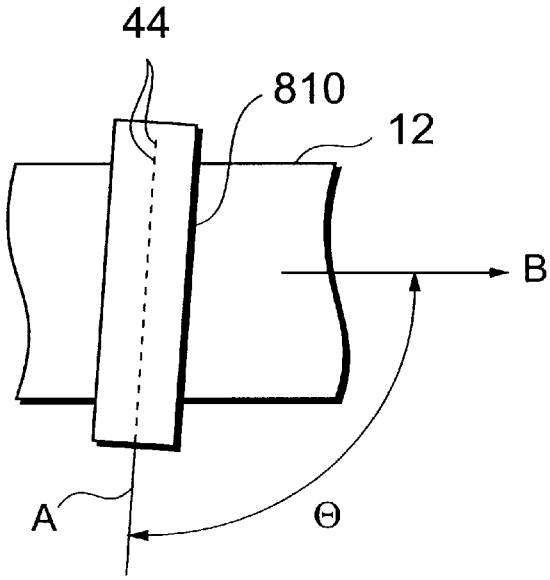
FIG. 21 is a view showing another example of arrangement of the image forming section.

FIGS. 20 and 21 are views showing examples of arrangement of an image forming section (recording head) used in each of the foregoing embodiments. The recording head 810 shown in FIG. 20 has a plurality of ink ejection ports 44 aligned on a straight line A which is wider than the width of an image receiving medium, i.e., print paper. This recording head 810 is provided in such a manner that an angle Θ defined by an intersection of the straight line A on which the ink ejection ports 44 are aligned and a direction B for feeding the print paper 12 becomes 90° or substantially 90°. The image forming section 810 shown in FIG. 21 is inclined in such a manner that the angle Θ defined by an intersection of the straight line A and the feeding direction B does not become 90°.

According the example shown in FIG. 20, the ink ejection ports 44 of the recording head 810 must be provided at intervals which are equal to those of the pixels. According to the example shown in FIG. 21, an interval between the respective ink ejection ports 44 can be larger than that between the ink ejection ports 44 shown in FIG. 20. As a result, production of the recording head 810 can be facilitated.

Figure 22:
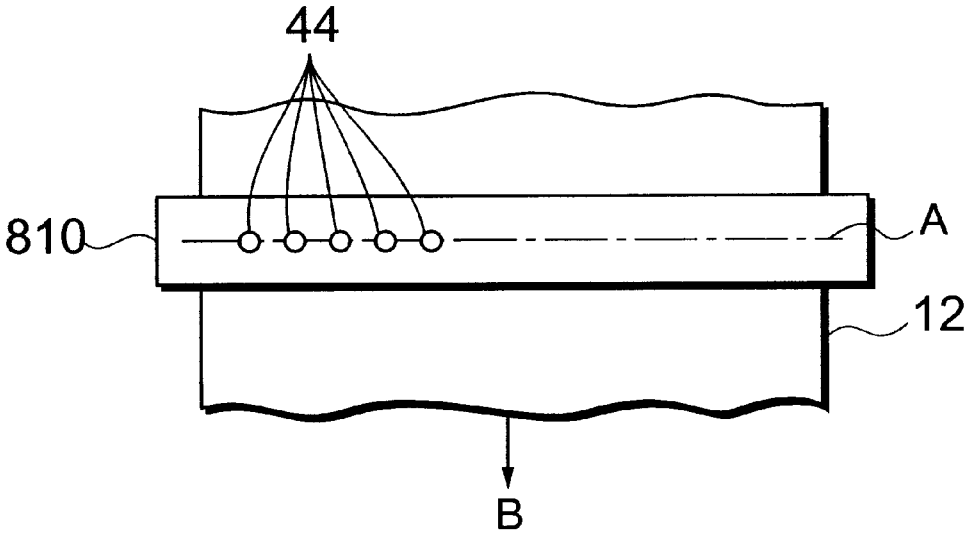
FIG. 22 is an enlarged view of the image forming section.
Figure 23:
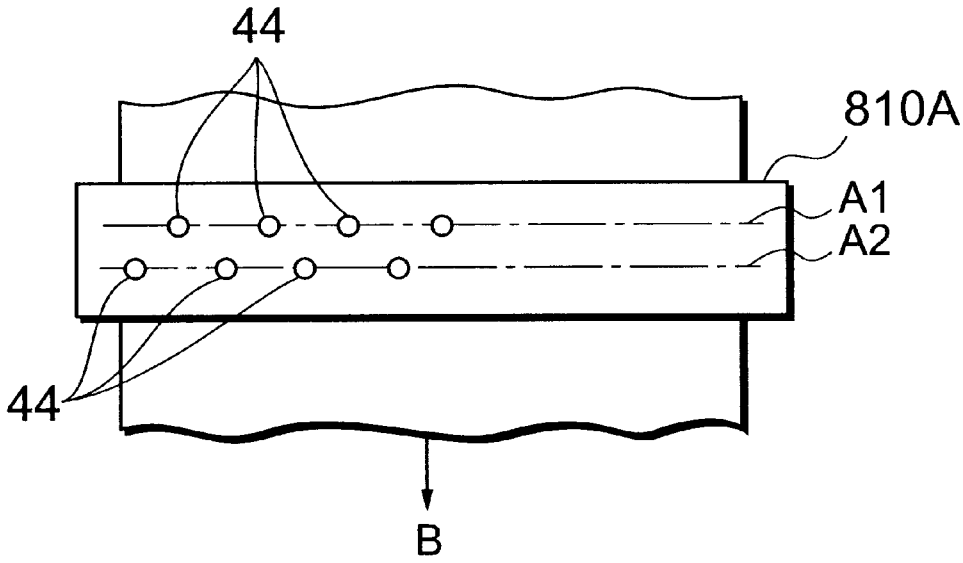
FIG. 23 is an enlarged view showing another embodiment of the image forming section.

FIG. 22 is an enlarged view of the image forming section 810, and FIG. 23 is an enlarged view showing another embodiment of the image forming section. As described above, the image forming section 810 has a plurality of ink ejection ports 44 aligned on the straight line A. On the other hand, the adjacent ink ejection ports 44 are distributed on two parallel straight lines A1 and A2 in the image forming section 810A shown in FIG. 23.

According to the image forming section (recording head) 810A illustrated in FIG. 23, an interval between the adjacent ink ejection ports 44 on the respective straight line A1 and A2 can be enlarged to double the interval shown in FIG. 22. This can facilitate production of the image forming section 810A. Incidentally, the ink ejection ports 44 can be distributed on three or more straight lines in place of the two straight lines A1 and A2, which further facilitates production of the image forming section. When distributing the ink ejection ports 44 to be aligned on the different straight lines A1 and A2, a plurality of image forming sections having the ink ejection ports 44 aligned on one straight line can be staggered by an amount of pitch of the pixel in the width direction of the print paper 12 so as to closely overlap one on another.

In the above-described embodiments, the flow control valve (24, 26 or 624) changes the cross sectional area of the ink channel by driving the diaphragm valve by using the piezoelectric device and the ink flow controlling means using the check valve, the cavity and the movable member which drives the movable member by using the piezoelectric device has been explained. However, the flow control valve or the movable member may utilize the driving force based on a principle other than the piezoelectric device. For example, those utilizing the heat-pressure effect, the electrostatic attraction force or the electrostatic repulsive force can be used. The heat-pressure effect cited herein means that the fluid (this may be the ink itself) whose fluid resistance largely changes due to a temperature is used and the diaphragm is driven by utilizing a change in fluid pressure caused by changing a fluid temperature by a heater at one point in the fluid channel.

Further, the diaphragm valve or the movable member may be driven by utilizing the magnetic distortion effect or the effect of interfacial tension of fluid different from fluids (inks) used for forming an image. Also, heat of the fluids different from the fluid used for forming an image and/or a pressure of a bubble generated by electrolytes may be used. Moreover, a change in channel resistance of the fluid different from ink fluids used for forming an image can generate a change in pressure of this fluid by changing other physical or chemical characteristics such as an electric field or a magnetic field, instead of changing the channel resistance by using heat with the heat-pressure effect, thereby using this change in pressure to drive the diaphragm or the movable member.

It is possible to use the diaphragm for opening/closing the ink channel, which has a structure for holding a valve plate for closing the ink channel by a center impeller beam or a cantilever beam. That is, when the diaphragm has such a structure as that the opening of the ink channel is substantially-vertically opposed to the valve plate and this valve plate is pushed by an actuator such as a piezoelectric device from the opening of the ink channel and the surface on the opposed side, the center impeller beam or the cantilever beam is used as this valve plate.

In the embodiment shown in FIG. 2, the pumps 32, 34 eject or extrude the ink with a fixed pressure, and a quantity of ejection of each type of ink is separately controlled by the flow adjusting valves 24, 26. Further, in the embodiments shown in FIGS. 5 and 6, quantities of ejection of ink from the pumps 132, 334, 232 and 234 are independently variable. Furthermore, in the embodiment shown in FIG. 7, each quantity of ejection of ink is variable with the ink feed pumps 332 and 334.

In the present invention, not only is each type of ink supplied with a fixed or constant pressure to control a quantity of ejection by the flow adjusting valve (the embodiment in FIG. 2) or is a quantity of ejection of each type of ink variable by each pump (the embodiments in FIGS. 5, 6 and 7), but a part of ink may be supplied with a fixed or constant pressure and a quantity of ejection of any other type of ink may be variable. For example, the clear ink (which is transparent and colorless at least after dried out) may be continuously supplied with a fixed or constant pressure by using no flow adjusting valve, while a quantity of ejection of any other colored ink may be variable by the flow control valve (one shown in FIG. 2), the pump by which a quantity of ejection is variable (one shown in FIGS. 5 and 6) or the ink feed pump (one shown in FIG. 7).

In this case, since a section area of the ink channel through which all types of ink collectively pass is always constant, a quantity of a flow of one type of ink supplied with a fixed pressure naturally changes by varying a quantity of ejection of the other type of ink which is under control. When the clear ink is supplied with a fixed pressure by using no flow control valve, the ink channel for the clear liquid may be branched into plural channels in the form of array in the recording head so that the clear liquid can be equally led from one ink pump to each ink ejection port, thereby simplifying the structure of the recording head.

In the above-described embodiment, as apparent from the drawings, the first ink channel 20 for supplying the clear or transparent ink and the second ink channel 22 for supplying the colored ink are set in such a manner that the cross sectional area of the first ink channel 20 is larger than that of the second ink channel 22 at a confluence of these channels. This setting is used in order that the density having high fidelity to the image signal can be obtained by properly mixing the second ink (colored ink) to the first ink (clear ink) even if a quantity of ejection of the second ink is small.

More specifically, when a quantity of ejection of the second ink is lowered, the ejection length of the second ink in the ink channel becomes excessively small. Therefore, the flow of the second ink can not smoothly disconnected from the second ink channel at the ejection port (the confluence with the first ink). A quantity of ejection of the second ink can not be controlled in the small quantity range. As a countermeasure, the section area of the second ink channel at the confluence with the first ink is reduces so as to enlarge the ejection length of the second ink from the second ink channel to the confluence. With such a construction, the leading end of the second ink joins to and flows together with the first ink to be smoothly disconnected from the second ink channel even if a quantity of ejection of the second ink is small.

For example, in a widely-used ink jet printer, a quantity of ink used for forming one pixel has an order of approximately 10 pL (pico-liter, $=10^{-12}$ L$=10^{-9}$ cm$^3$). In order to express a change in density of, e.g., 100 tones with this quantity, the quantity of colored ink must be controlled by the order of 10 pL×(1/100)=0.1 pL. Assuming that the quantity of 0.1 pL is perfectly ensphered, an ink droplet having a diameter of 5.8 $\mu$m (micrometer, $=10^{-3}$ mm) can be obtained.

It is assumed that a cubic volume of the first and second ink with respect to one pixel after mixture is 30 pL and a proportion of flow rate of the first ink (clear ink) is 99/100 and that of the second ink (colored ink) is 1/100.

A flow rate $V_1$ of the first ink (clear ink) and a flow rate $V_2$ of the second ink (colored ink) can be respectively expressed as follows:

$$V_1=29.7\ \text{pL}=29.7\times10^{-12}\ \text{L}=29.7\times10^{-6}\ \text{mm}^3$$

$$V_2=0.3\ \text{pL}=0.3\times10^{-6}\ \text{mm}^3$$

Assuming that the section of the first ink channel 20 is a square having one side equal to 40 $\mu$m, its cross sectional area $S_1$ can be expressed as $S_1=40\times40\times10^{-6}$ mm$^2=16\times10^{-4}$ mm$^2$. Therefore, a distance $x_1$ that the first ink (clear ink) flows in the ink channel 20 can be represented as follows:

$$\begin{aligned} x_1 &= V_1/S_1 \\ &= (29.7/16)\times10^{-2}\ \text{mm} \\ &= 18.6\times10^{-3}\ \text{mm} \\ &= 18.6\ \mu\text{m} \end{aligned}$$

Here, it is presumed that the cross sectional area $S_2$ of the second ink channel 22 in the vicinity of a confluence and the first ink channel 20 with respect to the second ink is equal to the cross sectional area $S_1$ of the first ink channel 20. Namely, $S_2=S_1$ is assumed. A distance $x_2$ that the second ink flows into the first ink channel 20 can be expressed as follows.

$$\begin{aligned} x_2 &= V_2/S_2 \\ &= (0.3/16)\times10^{-2}\ \text{mm} \\ &= 0.186\ \mu\text{m} \end{aligned}$$

That is, a proportion of the distance $x_2$ of the second ink (colored ink) to the distance $x_1$ of the first ink (clear ink) becomes 1/100.

Here, the second ink flows in the first ink channel 20 by only the distance $x_2$. However, since this distance, i.e., a quantity of ingress $x_2$ is extremely small, the second ink can not overcome the surface tension thereof and the second ink can not be released into the first ink. At this time, the leading end of the second ink just slightly moves into or from the first ink channel 20, the first ink is not mixed with the second ink. That is, the leading end of the second ink can not be smoothly disconnected.

As a countermeasure, the front edge of the second ink channel 22, i.e., a portion at which the second ink channel 22 becomes confluent with the first ink channel 20 is so formed as to have a nozzle-like shape having a small diameter. By doing so, a quantity of ingress of the second ink (colored ink) into the first ink (clear ink) channel 20 is increased to improve disconnection of the second ink, thereby enabling control of an extremely small amount of the second or colored ink which is the image forming ink.

The above has described as to the embodiments for forming an image. That is, description has been given as to two-dimensional drawing of an image on a sheet of paper or a film. However, the present invention can be used for production of a mosaic filter for use in an image display device such as a liquid crystal color display, i.e., a color filter in which color mosaics of yellow, magenta and cyan are repeatedly arranged. Further, the present invention can be also applied to manufacturing of an industrial product for forming a spatially repeated pattern.

As described above, since the present invention controls a flow rate of at least one image forming ink, which substantially forms an image after dried out, of a plurality of inks in such a manner that a volume flow rate per unit time of that ink does not become always zero, it is possible to prevent the image quality from being deteriorated by mixture due to diffusion of the inks.

When it is determined that a minimum addition amount of the image forming ink to be constantly added is such a value as that a change in optical density of the ink liquid fluid caused due to addition of that ink becomes less than 0.1, the image is hardly deteriorated. Undesired mixing of a plurality of inks including this image forming ink due to diffusion of the respective inks can be further suppressed by causing the respective inks to be confluent while absorbing the vibration. Accordingly, correction of the density tone of an image can be decreased by reducing the minimum addition amount of the ink, which is suitable for improving the image quality.

When at least one of multiple inks used herein is the image non-forming ink which substantially forms no image after dried out and a mixture proportion of the multiple inks is controlled so that this image non-forming ink is always contained, the image density can be changed by varying a mixture proportion of the image non-forming ink, and the color degradation of the image can be prevented or any other special property can be imparted by containing color degradation preventing agent and the like in the image non-forming ink.

An image whose density and/or color two-dimensionally changes can be formed by controlling a quantity of flow of multiple inks in accordance with different pixels in the width direction of the image receiving medium (a direction orthogonal or substantially-orthogonal to the moving direction of the same). In this case, the ink ejection ports associated with the respective pixels can be independently formed.

The ink droplets can be transported to the image receiving medium from the ink ejection ports independently formed in the above-mentioned manner by the ink jet mode. As the ink jet mode used in this example, a piezo ink jet mode, a thermal ink jet mode, a continuous ink jet mode, an electrostatic attraction ink jet mode, an ultrasonic ink jet mode and others can be used.

An image may be formed by a mode for transporting the ink liquid ejected or extruded from the ink ejection port as a continuous fluid flow to the image receiving medium, i.e., the continuous coating mode. In this case, although the ink liquid can be ejected from the ink ejection port provided for each pixel as a continuous flow and applied onto the image receiving medium, the ink liquid may be ejected through a slot for connecting the respective ink ejection ports. In such a case, the multiple inks constituting the ink liquid can be used as a layer flow having no turbulence without being mixed and any ink can be always positioned on the image receiving medium side or the surface side to be applied, thereby further improving the image quality.

A quantity of flow of the ink can be controlled by changing a channel section area for a plurality of inks, and the channel control valve using the piezoelectric device is thus provided to the ink channel to drive the piezoelectric device by a mechanical resonance frequency inherent to this device in order to control a quantity of flow of the ink by using the pulse number of this frequency.

In place of controlling the section area of the ink channel, a quantity of flow of the ink may be controlled by changing a discharge quantity of the ink from the ink feed pump. As the ink feed pump used in this example, one including at least one check valve provided to the ink channel, a cavity provided in the vicinity of this check valve, and a movable member for changing a capacity of this cavity can be used. As the check valve used in this example, it is possible to employ one having a geometric shape, e.g., a restriction or restrictor by which the fluid resistance relative to a direction of a flow of the ink becomes small while the counterpart relative to the reverse direction becomes large.

As to the ink feed pump, one using a pulse motor capable of controlling a quantity of ejection by a pulse number can be used. In this case, the individual ink feed pumps for ejecting the respective inks may be driven by the pulse motors and the control may be executed in such a manner that a sum of the driving pulse numbers of the multiple motors for driving the pumps for the respective inks becomes constant.

Further, according to the present invention, the image forming apparatus which is directly used for implementing the above-described method can be obtained. When controlling a quantity of flow of each ink by the flow control valve provided to each ink channel, the flow control valve can be constituted by the diaphragm valve driven by the piezoelectric device. The flow control valve may be formed by the diaphragm valve driven by the heat-pressure effect or another diaphragm valve driven by the electrostatic attraction force or the electrostatic repulsive force.

A quantity of ejection of the ink feed pump can be controlled in place of using the flow control valve. Although the ink feed pump using the pulse motor can be used, it can be formed by the piezoelectric device and the check valve. The ink feed pump can be constituted by the check valve, the cavity provided in the vicinity of the check valve, and the movable member. Here, as the check valve, one having a geometric shape by which the flow resistance to a direction of a flow of the ink becomes smaller than that to the reverse direction can be used.

As the movable member used in this example, it is possible to use a diaphragm driven by the piezoelectric device, a diaphragm driven by the heat-pressure effect, a diaphragm driven by the electrostatic attraction force or the electrostatic repulsive force, a diaphragm driven by the magnetic distortion effect, a diaphragm driven by the interfacial tension effect of the fluid different from the ink, a diaphragm driven by a bubble generated by electrolyzing the fluid different from the ink, and others.

The ink ejection ports can be independently opposed to the image receiving medium in accordance with each pixel, and the ink liquid can be led to the image receiving medium by the ink transporting means adopting the ink jet mode.

The ink ejection ports can transport the ink liquid fluid to the image receiving medium as a continuous fluid flow therefrom (the continuous coating mode). In this case, when the respective ink ejection ports are formed in a common slot to eject the ink liquid through this slot, since a plurality of inks can be applied as a layer flow without being mixed, the image quality can be improved by imparting a special property to the ink coming into contact with the image receiving medium or the ink exposed on the surface. It is to be noted that the image receiving medium includes an intermediate image receiving medium such as a drum as well as the final image receiving medium such as the print paper.

As the image forming section (recording head) used in the image forming apparatus, one having the ink ejection ports aligned on a straight line orthogonal or substantially orthogonal to a relative displacement direction of the image receiving medium can be used. However, when the straight line on which the ink ejection ports are arranged is inclined with respect to the relative displacement direction of the image receiving medium, a gap between the respective ink ejection ports can be enlarged.

In the image forming section (recording head), the adjacent ink ejection ports may be distributed on a plurality of straight lines orthogonal or substantially orthogonal to the relative displacement direction of the image receiving medium (Claim 39). In this case, since an interval between the ink ejection ports aligned on the respective straight lines is enlarged, production of the coating head can be further facilitated.

What is claimed is:

1. An image forming method for forming an image on an image receiving medium with an ink liquid, said ink liquid including a plurality of inks, at least one of the plurality of the inks being an image forming ink for substantially forming an image after drying out, a mixture proportion of the plurality of said inks being changed with respect to a pixel based on an image signal; said method comprising:

supplying the plurality of the inks to an ink ejection port through a plurality of respective ink channels so that a not less than predetermined minimum amount of said image forming ink is always supplied;

mixing the plurality of said inks at an upstream portion of the ink ejection port to produce said ink liquid;

correcting a density of the pixel in accordance with said minimum amount of the image forming ink so that said mixture proportion of the plurality of the inks is corrected;

controlling an ink flow rate of the respective inks in the respective ink channels based on the corrected mixture proportion in such a manner that a volume flow rate per unit time of said image forming ink does not become zero; and transporting said ink liquid from the ink ejection port to the image receiving medium, said image receiving medium being moved relatively to the ink ejection port, to form the image thereon.

2. The image forming method according to claim 1, wherein said predetermined minimum amount of said image forming ink is such an amount as that a change in optical density of said ink liquid caused due to the addition of said image forming ink is less than 0.1.

3. The image forming method according to claim 1, further comprising:

performing vibration absorption while joining the plurality of said inks including said image forming ink in a confluent flow to form said ink liquid.

4. The image forming method according to claim 1, wherein at least one ink in the plurality of said inks is an image non-forming ink which substantially does not form an image after drying out and the mixture proportion of the plurality of said inks is controlled so that said ink liquid always contains said image non-forming ink.

5. The image forming method according to claim 1, wherein flow rates of the plurality of said inks are controlled in accordance with different pixels substantially orthogonal to a moving direction of said image receiving medium.

6. The image forming method according to claim 1, wherein the plurality of said ink ejection ports are provided with different pixels and each ink ejection port ejects said ink liquid in which the plurality of said inks have flow rates controlled in accordance with different pixels.

7. The image forming method according to claim 1, wherein said ink liquid ejected from said ink ejection port is transported to said image receiving medium as a continuous fluid flow to form the image.

8. The image forming method according to claim 1, wherein the plurality of said ink ejection ports are provided with different pixels and each ink ejection port ejects said ink liquid in which the plurality of said inks have flow rates controlled in accordance with different pixels; and wherein said ink liquids ejected from the plurality of said ink ejection ports are transported to said image receiving medium as a continuous fluid flow through a slot connecting said respective ink ejection ports to form the image.

9. The image forming method according to claim 1, wherein said ink flow rate of the respective inks is controlled by changing a cross sectional area of the respective ink channels.

10. The image forming method according to claim 9, wherein said cross sectional area of the respective ink channel is controlled by a piezoelectric device.

11. The image forming method according to claim 10, wherein said piezoelectric device is driven by a mechanical resonance frequency inherent thereto and said ink flow rate of the respective inks is controlled by changing a pulse number of said frequency.

12. The image forming method according to claim 1, wherein an ink channels for supplying one type of said inks to said ink ejection port has a section area larger than another section area of another ink channel for supplying another type of said inks at a confluence where said ink channels join.

13. The image forming method according to claim 12, wherein the one type of said inks is said image non-forming ink for substantially forming no image after drying out, and the another type of said ink is said image forming ink.

14. The image forming method according to claim 1, wherein said predetermined minimum amount is an amount required for to refreshing a volume of the image forming ink mixed with any other inks by natural diffusion.

15. An image forming apparatus for forming an image on an image receiving medium with an ink liquid, said ink liquid including a plurality of inks, at least one of the plurality of the inks being an image forming ink for substantially forming an image after drying out, a mixture proportion of the plurality of said inks being changed with respect to a pixel based on an image signal; said image forming apparatus comprising:

an ink ejection port for ejecting said ink liquid to the image receiving medium which is moved relatively to the ink ejection port;

a plurality of ink channels for supplying a plurality of respective inks to said ink ejection port to produce said ink liquid;

ink flow controlling means for independently controlling an ink flow rate of the respective inks in the respective ink channels so that a flow rate of said image forming ink is not less than a predetermined minimum flow rate;

a processor for determining the mixture proportion of the plurality of said inks based on the image signal and for calculating an ink flow rate of the respective inks, wherein a density of the pixel is corrected in accordance with said minimum flow rate so that said mixture proportion of the plurality of said inks is corrected, and wherein the respective ink flow rate of the respective inks is calculated based on the corrected mixture proportion; and a driver for driving said ink flow controlling means based on a result of a calculation by said processor.

16. The image forming apparatus according to claim 15, wherein said ink flow controlling means is formed by a flow control valve operatively connecting the respective ink channels and changing an area of the respective ink channels.

17. The image forming apparatus according to claim 16, wherein said flow control valve is a diaphragm valve driven by a piezoelectric device.

18. The image forming apparatus according to claim 16, wherein said flow control valve is a diaphragm valve driven by a thermal-pressure effect.

19. The image forming apparatus according to claim 16, wherein said flow control valve is a diaphragm valve driven by an electrostatic attraction force or an electrostatic repulsive force.

20. The image forming apparatus according to claim 15, a plurality of said ink ejection ports being aligned in accordance with respective pixels substantially orthogonal to a moving direction of said image receiving medium and each ink ejection port is independently opposed to said image receiving medium.

21. The image forming apparatus according to claim 15, wherein said ink liquid is ejected from said ink ejection port to be transported to said image receiving medium as a continuous fluid flow.

22. The image forming apparatus according to claim 21, wherein said image receiving medium is an intermediate image receiving medium for receiving said continuous fluid ejected from said ink ejection port and transferring said continuous fluid to a final image receiving medium.

23. The image forming apparatus according to claim 15, wherein a plurality of said ink ejection ports are provided in accordance with the respective pixels and formed in a slot opposed to said image receiving medium, said ink liquid ejected from each ink ejection ports being integrated and zonally transported to said image receiving medium from said slot as a continuous fluid flow.

24. The image forming apparatus according to claim 23, wherein said image receiving medium is an intermediate image receiving medium for receiving said continuous fluid ejected from said slot and transferring said continuous fluid to a final image receiving medium.

25. The image forming apparatus according to claim 15, wherein an ink channel for supplying one type of said inks to said ink ejection port has a section area larger than another section area of another ink channel for supplying another type of said ink at a confluence where said ink channels join.

26. The image forming apparatus according to claim 25, wherein the one type of said inks is the image non-forming ink for substantially forming no image after drying out, and the another type of said inks is said image forming ink.

27. A recording head for use in the image forming apparatus according to claim 15, wherein a plurality of said ink ejection ports are provided to be arranged on a straight line substantially orthogonal to a relative displacement direction of an image receiving medium.

28. A recording head for use in the image forming apparatus according to claim 15, wherein a plurality of said ink ejection ports are provided so that adjacent ink ejection ports are distributed on a plurality of parallel straight lines substantially orthogonal to a relative displacement direction of an image receiving medium.

29. The image forming apparatus according to claim 15, wherein said predetermined minimum flow rate for said image forming ink is not less than a flow rate for refreshing a volume of the image forming ink mixed with any other inks by natural diffusion.

30. The image forming apparatus according to claim 15, further comprising a mechanism for performing vibration absorption at a portion where the plurality of said inks becomes confluent.

31. An image forming method for forming an image on an image receiving medium with an ink liquid, said ink liquid including a plurality of inks, at least one of the plurality of the inks being an image forming ink for substantially forming an image after drying out, a mixture proportion of the plurality of said inks being changed with respect to a pixel based on an image signal; said method comprising:

supplying the plurality of the inks to an ink ejection port through a plurality of respective ink channels;

mixing the plurality of said inks at an upstream portion of the ink ejection port to produce said ink liquid;

controlling an ink flow rate of the respective inks in the respective ink channels in such a manner that a volume flow rate per unit time of said image forming ink does not become zero;

transporting said ink liquid from the ink ejection port to the image receiving medium, said image receiving medium being moved relatively to the ink ejection port, to form the image thereon; and performing vibration absorption while joining the plurality of said inks including said image forming ink in a confluent flow to form said fluid.

32. An image forming method for forming an image on an image receiving medium with an ink liquid, said ink liquid including a plurality of inks, at least one of the plurality of the inks being an image forming ink for substantially forming an image after drying out, a mixture proportion of the plurality of said inks being changed with respect to a pixel based on an image signal; said method comprising:

supplying the plurality of the inks to an ink ejection port through a plurality of respective ink channels;

mixing the plurality of said inks at an upstream portion of the ink ejection port to produce said ink liquid;

controlling an ink flow rate of the respective inks in the respective ink channels in such a manner that a volume flow rate per unit time of said image forming ink does not become zero; and transporting said ink liquid from the ink ejection port to the image receiving medium, said image receiving medium being moved relatively to the ink ejection port, to form the image thereon;

wherein said ink flow rate of the respective inks is controlled by changing a cross sectional area of the respective ink channels, and wherein said cross sectional area of the respective ink channel is controlled by a piezoelectric device which is driven by a mechanical resonance frequency inherent thereto and said ink flow rate of the respective inks is controlled by changing a pulse number of said frequency.

33. The image forming method according to claim 1, wherein said ink liquid ejected from said ink ejection ports is transported to said image receiving medium by an ink jet mode.

34. The image forming method according to claim 33, wherein said ink jet mode is any of a piezo ink jet mode, a thermal ink jet mode, a continuous ink jet mode, an electrostatic attraction ink jet mode, and an ultrasonic ink jet mode.

35. The image forming method according to claim 1, wherein said ink flow rate of the respective inks is controlled by changing a discharge quantity of an ink feed pump.

36. The image forming method according to claim 35, wherein said ink feed pump includes at least one check valve provided to said respective ink channels, a cavity provided in the vicinity of said check valve and a movable member for changing a capacity of said cavity, and said ink is ejected by changing a capacity of said cavity by using said movable member.

37. The image forming method according to claim 36, wherein said check valve has a geometric form that a resistance relative to a flow direction of said ink toward said ink ejection ports is smaller than a resistance relative to a reverse direction with respect to said flow direction.

38. The image forming method according to claim 35, said ink feed pump being driven by a pulse motor.

39. The image forming apparatus according to claim 15, wherein said ink flow controlling means is formed by an ink feed pump which is operatively connected to the respective ink channels and driven by a pulse motor.

40. The image forming apparatus according to claim 15, wherein said ink flow controlling means is formed by an ink feed pump which is operatively connected to the respective ink channels and uses a piezoelectric device and a check valve.

41. The image forming apparatus according to claim 15, wherein said ink flow controlling means includes a check valve provided to the respective ink channels, a cavity provided in the vicinity of said check valve and a movable member for changing a capacity of said cavity, and said ink flow controlling means ejects an ink by changing a capacity of said cavity by using said movable member.

42. The image forming apparatus according to claim 41, wherein said check valve has a geometric form that a resistance relative to an ink flow direction toward said ink ejection port is smaller than a resistance relative to a reverse direction with respect to said ink flow direction.

43. The image forming apparatus according to claim 41, wherein said movable member is a diaphragm driven by a piezoelectric device.

44. The image forming apparatus according to claim 41, wherein said movable member is a diaphragm driven by a heat-pressure effect.

45. The image forming apparatus according to claim 41, wherein said movable member is a diaphragm driven by an electrostatic attraction force or an electrostatic repulsive force.

46. The image forming apparatus according to claim 41, wherein said movable member is a diaphragm driven by a magnetic distortion effect.

47. The image forming apparatus according to claim 41, wherein said movable member is a diaphragm driven by an interfacial tension effect of a fluid different from the plurality of said inks used for forming an image.

48. The image forming apparatus according to claim 41, wherein said movable member is a diaphragm driven by a bubble generated by electrolyzing a fluid different from the plurality of said inks used for forming an image.

49. The image forming apparatus according to claim 15, further comprising ink transporting means for leading said ink liquid ejected from said ink ejection port to said image receiving medium by an ink jet mode.

* * * * *